US011855349B2

(12) United States Patent
Zimmerman

(10) Patent No.: US 11,855,349 B2
(45) Date of Patent: Dec. 26, 2023

(54) LENSED BASE STATION ANTENNAS HAVING FUNCTIONAL STRUCTURES THAT PROVIDE A STEP APPROXIMATION OF A LUNEBERG LENS

(71) Applicant: CommScope Technologies LLC, Hickory, NC (US)

(72) Inventor: Martin L. Zimmerman, Chicago, IL (US)

(73) Assignee: CommScope Technologies LLC, Claremont, NC (US)

( * ) Notice: Subject to any disclaimer, the term of this patent is extended or adjusted under 35 U.S.C. 154(b) by 435 days.

(21) Appl. No.: 17/283,483

(22) PCT Filed: Nov. 1, 2019

(86) PCT No.: PCT/US2019/059388
§ 371 (c)(1),
(2) Date: Apr. 7, 2021

(87) PCT Pub. No.: WO2020/096896
PCT Pub. Date: May 14, 2020

(65) Prior Publication Data
US 2021/0399433 A1 Dec. 23, 2021

Related U.S. Application Data

(60) Provisional application No. 62/756,697, filed on Nov. 7, 2018.

(51) Int. Cl.
*H01Q 19/06* (2006.01)
*H01Q 1/24* (2006.01)
(Continued)

(52) U.S. Cl.
CPC ..... *H01Q 19/062* (2013.01); *H01Q 1/24* (2013.01); *H01Q 1/246* (2013.01); *H01Q 15/08* (2013.01);
(Continued)

(58) Field of Classification Search
CPC ..... H01Q 19/062; H01Q 19/06; H01Q 1/246; H01Q 1/24; H01Q 1/42; H01Q 15/08; H01Q 21/08; H01Q 21/26
(Continued)

(56) References Cited

U.S. PATENT DOCUMENTS 3,133,285 A 5/1964 Jordan et al.
3,293,649 A 12/1966 Fox et al.
(Continued)

FOREIGN PATENT DOCUMENTS

CN 104659496 A 5/2015
CN 105470659 A 4/2016
(Continued)

OTHER PUBLICATIONS

"International Search Report and Written Opinion of the International Searching Authority", PCT/US2019/059388, dated Jan. 13, 2020, 13 pp.
(Continued)

*Primary Examiner* — Hai V Tran
(74) *Attorney, Agent, or Firm* — Myers Bigel, P.A.

(57) ABSTRACT

A lensed base station antenna includes a first array of radiating elements that are configured to transmit respective sub-components of a first RF signal and an RF lens positioned to receive electromagnetic radiation from a first of the radiating elements. The RF lens includes a lens casing, an RF energy focusing material within the lens casing and a first heat dissipation element that extends through the RF energy focusing material. The RF lens is configured to be at
(Continued)

least a three step approximation of a Luneberg lens along a bore sight pointing direction of the first of the radiating elements.

20 Claims, 15 Drawing Sheets

(51) Int. Cl.
*H01Q 15/08* (2006.01)
*H01Q 21/08* (2006.01)
*H01Q 21/26* (2006.01)
*H01Q 1/42* (2006.01)

(52) U.S. Cl.
CPC ..... *H01Q 19/06* (2013.01); *H01Q 21/08* (2013.01); *H01Q 21/26* (2013.01); *H01Q 1/42* (2013.01)

(58) Field of Classification Search
USPC ..... 343/702
See application file for complete search history.

(56) References Cited

U.S. PATENT DOCUMENTS

| | | | | |
|---|---|---|---|---|
| 4,973,965 | A | 11/1990 | Ridge et al. | |
| 5,677,796 | A | 10/1997 | Zimmerman et al. | |
| 6,426,814 | B1 | 7/2002 | Berger et al. | |
| 7,405,710 | B2 | 7/2008 | Bisiules et al. | |
| 9,819,094 | B2 | 11/2017 | Matitsine et al. | |
| 11,539,110 | B2 | 12/2022 | Kaistha et al. | |
| 2007/0263856 | A1 | 11/2007 | Parsa | |
| 2011/0003131 | A1 | 1/2011 | Matitsine | |
| 2011/0205119 | A1 | 8/2011 | Timofeev et al. | |
| 2012/0020020 | A1 | 1/2012 | Julien et al. | |
| 2015/0070230 | A1* | 3/2015 | Bradley | H01Q 19/062 343/753 |
| 2015/0091767 | A1 | 4/2015 | Matitsine et al. | |
| 2017/0062944 | A1* | 3/2017 | Zimmerman | H01Q 21/061 |
| 2018/0131078 | A1 | 5/2018 | Shooshtari et al. | |
| 2018/0166789 | A1* | 6/2018 | Galla | H01Q 15/08 |
| 2018/0337442 | A1* | 11/2018 | Deng | H01Q 1/36 |

FOREIGN PATENT DOCUMENTS

| | | | |
|---|---|---|---|
| CN | 106207482 | A | 12/2016 |
| EP | 1098455 | A2 | 5/2001 |
| WO | 0128162 | A1 | 4/2001 |
| WO | 2015139294 | A1 | 9/2015 |
| WO | 2020041467 | A1 | 2/2020 |

OTHER PUBLICATIONS

"Indian Examination Report in Corresponding Patent Application No. 202127016460, dated Dec. 21, 2022, 7 pages".
International Search Report and the Written Opinion of the International Searching Authority corresponding to International Patent Application No. PCT/US2019/055173 (12 pages) (dated Jan. 2, 2020).
"Chinese Office Action in Corresponding Application No. 201980073202.X, dated Apr. 20, 2023, 13 pages".

* cited by examiner

LENSED BASE STATION ANTENNAS HAVING FUNCTIONAL STRUCTURES THAT PROVIDE A STEP APPROXIMATION OF A LUNEBERG LENS

CROSS-REFERENCE TO RELATED APPLICATIONS

The present application is a 35 U.S.C. § 371 national stage application of PCT Application No. PCT/US2019/059388, filed on Nov. 1, 2019, which itself claims priority under 35 U.S.C. § 119 to U.S. Provisional Patent Application Ser. No. 62/756,697, filed Nov. 7, 2018, the entire contents of both of which are incorporated herein by reference as if set forth in their entireties.

FIELD OF THE INVENTION

The present invention generally relates to radio communications and, more particularly, to lensed antennas utilized in cellular communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower or other raised structure, with the radiation beam ("antenna beam") that is generated by each antenna directed outwardly to serve a respective sector.

A common base station configuration is a "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that each antenna beam provides good coverage throughout a 120° sector. Typically, each base station antenna will include one or more vertically-extending columns of phase-controlled radiating elements that are referred to as "linear arrays." Herein, "vertical" refers to a direction that is perpendicular relative to the plane defined by the horizon.

Sector-splitting refers to a technique where the coverage area for a base station is divided into more than three sectors, such as six, nine or even twelve sectors. A six-sector base station will have six 60° sectors in the azimuth plane. Splitting each 120° sector into multiple smaller sub-sectors increases system capacity because each antenna beam provides coverage to a smaller area, and therefore can provide higher antenna gain and/or allow for frequency reuse within a 120° sector. In sector-splitting applications, a single multibeam antenna is typically used for each 120° sector. The multibeam antenna generates two or more antenna beams within the same frequency band, thereby splitting the sector into two or more smaller sub-sectors.

One technique for implementing a multibeam antenna is to mount two or more linear arrays of radiating elements that operate in the same frequency band within an antenna that are pointed at different azimuth angles, so that each linear array covers a pre-defined portion of a 120° sector such as, for example, half of the 120° sector (for a dual-beam antenna) or a third of the 120° sector (for a tri-beam antenna). Since the azimuth beamwidth of typical radiating elements is usually appropriate for covering a full 120° sector, an RF lens may be mounted in front of the linear arrays of radiating elements that narrows the azimuth beamwidth of each antenna beam by a suitable amount for providing service to a sub-sector. Unfortunately, however, the use of RF lenses may increase the size, weight and cost of the base station antenna, and there may be other issues associated with the use RF lenses.

SUMMARY

Pursuant to embodiments of the present invention, lensed base station antennas are provided that include a first array that has a plurality of radiating elements that are configured to transmit respective sub-components of a first RF signal and an RF lens positioned to receive electromagnetic radiation from a first of the radiating elements. The RF lens includes a lens casing, an RF energy focusing material within the lens casing, and a first heat dissipation element that extends through the RF energy focusing material.

In some embodiments, the RF lens may be configured to be a step approximation of a Luneberg lens, where the step approximation is at least a three step approximation along a boresight pointing direction of the first of the radiating elements. In other embodiments, the step approximation may be at least a four step approximation.

In some embodiments, the RF lens may be one of a cylindrical RF lens, a spherical RF lens and an ellipsoidal RF lens.

In some embodiments, the first heat dissipation element may be a vertically-extending pipe that extends through the RF lens. In some embodiments, the vertically-extending pipe may include a plurality of vertically-extending internal channels. At least some of the internal channels may be air-filled channels. In some embodiments, a blended dielectric constant of the vertically-extending pipe and one or more materials that are within the internal channels of the vertically-extending pipe may exceed a dielectric constant of the RF energy focusing material. In some embodiments, some of the internal channels may be filled with air and others of the internal channels may be at least partially filled with the RF energy focusing material. In some embodiments, at least some of the internal channels may be air-filled channels that are adjacent an outer wall of the vertically-extending pipe. In some embodiments, a first of the vertically-extending internal channels may have a first length and a second of the vertically-extending internal channels may have a second length that is less than the first length.

In some embodiments, the lens casing may include a plurality of internal channels. A blended dielectric constant of the lens casing and one or more materials that are within the internal channels of the lens casing may be less than a dielectric constant of the RF energy focusing material.

In some embodiments, the lensed base station antenna may further include a second array that includes a plurality of radiating elements that are configured to transmit respective sub-components of a second RF signal, where the RF lens is positioned to receive electromagnetic radiation from a first of the radiating elements of the second array.

In some embodiments, the lensed base station antenna may further include a housing, where the RF lens is within the housing and the first heat dissipation element extends through the housing. In such embodiments, the first heat dissipation element may extend through a bottom end cap of the housing and/or the heat dissipation element may extend through a top of the housing.

In some embodiments, the lens casing may include a plurality of outwardly extending protrusions. The sizes and shapes of the outwardly extending protrusions may be selected to achieve a blended dielectric constant for the lens casing.

In some embodiments, the RF lens may be one of a spherical RF lens and an ellipsoidal RF lens, and the lens casing may be a two piece lens casing and each piece of the lens casing includes an outer lip.

Pursuant to further embodiments of the present invention, lensed base station antennas are provided that include a first array that includes a plurality of radiating elements that are configured to transmit respective sub-components of a first RF signal and an RF lens positioned to receive electromagnetic radiation from a first of the radiating elements, the RF lens including an outer lens casing that includes at least one air-filled internal channel and an RF energy focusing material within an interior of the outer lens casing.

In some embodiments, a blended dielectric constant of the outer lens casing may be less than a dielectric constant of the RF energy focusing material.

In some embodiments, the outer lens casing includes a plurality of air-filled internal channels.

In some embodiments, the RF lens may be a cylindrical RF lens that extends along a longitudinal axis, and the air-filled internal channels may extend parallel to the longitudinal axis.

In some embodiments, the lensed base station antenna may further include a first heat dissipation channel that extends through the RF energy focusing material.

In some embodiments, the RF lens may be configured to be a step approximation of a Luneberg lens, where the step approximation is at least a three step or a four step approximation along a boresight pointing direction of the first of the radiating elements.

In some embodiments, the first heat dissipation channel may be a vertically-extending pipe that extends through a center of the RF lens. The vertically-extending pipe may include a plurality of vertically-extending internal channels, and a first subset of the internal channels may be air-filled channels. In some embodiments, a blended dielectric constant of the vertically-extending pipe and one or more materials within the vertically-extending pipe may exceed a dielectric constant of the RF energy focusing material. In some embodiments, the RF energy focusing material may be included in a second subset of the vertically-extending internal channels. In some embodiments, at least some of the first subset of the internal channels may be adjacent an outer wall of the vertically-extending pipe.

In some embodiments, the lensed base station antenna may further include a housing and the RF lens may be within the housing and the first heat dissipation channel may extend through a bottom of the housing.

In some embodiments, the lens casing may include a plurality of outwardly extending protrusions.

In some embodiments, a first of the vertically-extending internal channels that extends through a center of the RF lens may have a first length and a second of the vertically-extending channels may have a second length that is less than the first length.

In some embodiments, the RF lens may be one of a spherical RF lens and an ellipsoidal RF lens, and the lens casing may be a two piece lens casing and each piece of the lens casing includes an outer lip.

Pursuant to still additional embodiments of the present invention, lensed base station antennas are provided that include a first array that includes a plurality of radiating elements that are configured to transmit respective sub-components of a first RF signal and an RF lens positioned to receive electromagnetic radiation from a first of the radiating elements. The RF lens includes a lens casing that has a plurality of outwardly extending ribs and at least one air-filled internal channel, and an RF energy focusing material is provided within the lens casing.

In some embodiments, the RF lens may be a step approximation of a Luneberg lens, where the step approximation is at least a three step approximation along a boresight pointing direction of the first of the radiating elements.

DETAILED DESCRIPTION

Figure 1A:
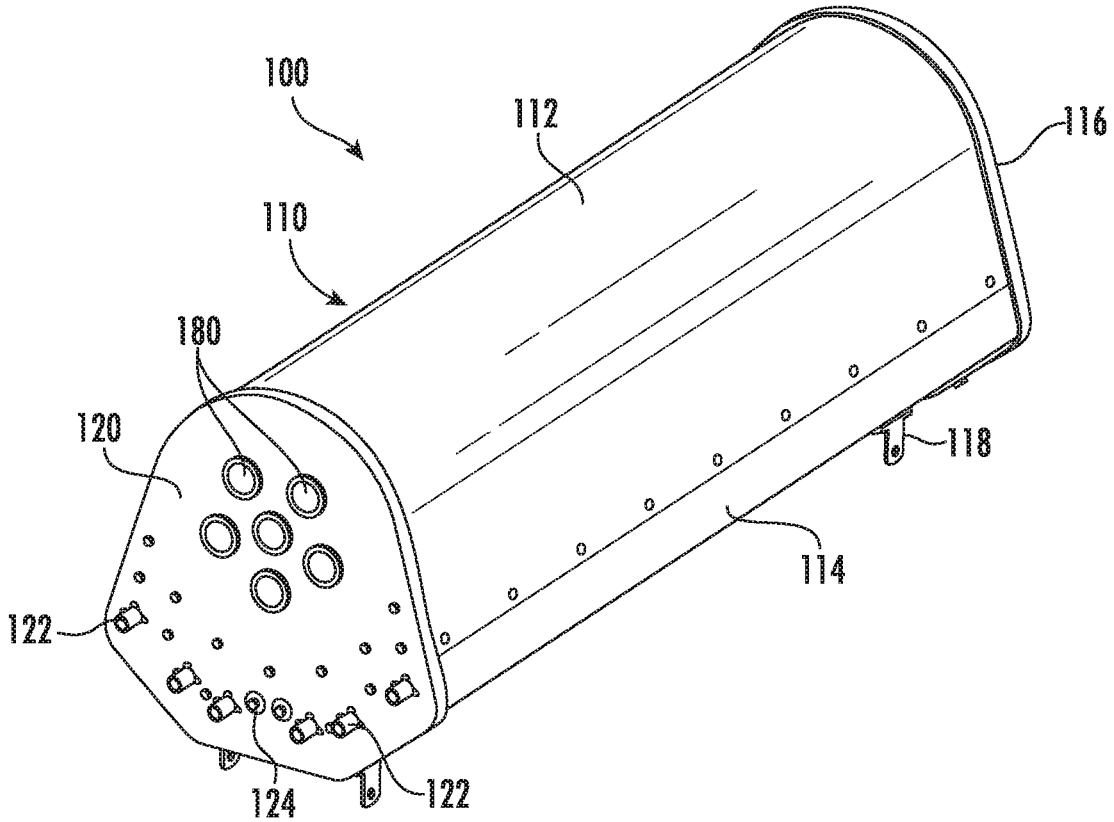
FIG. 1A is a perspective view of a lensed multibeam base station antenna.

As noted above, one approach for implementing sector splitting is providing base station antennas having two or more linear arrays of radiating elements that point to different portions of a sector, and using an RF lens to narrow the beamwidths of the antenna beams generated by the linear arrays so that the antenna beams are sized to provide coverage to respective portions of the sector. The RF lens includes an RF energy focusing material that narrows the beamwidths of the antenna beams. A variety of different RF energy focusing materials may be used to form an RF lens. For example, various dielectric materials are commercially available that may be used to focus RF energy incident thereto. Generally speaking, the higher the dielectric constant of the lens material, the more RF focusing that will occur. So-called "artificial" dielectric materials that include conductive materials dispersed within a dielectric base material to provide a composite material having electromagnetic properties similar to those of high dielectric constant dielectric materials have been proposed for use in RF lenses because such materials may have lower weight and/or lower cost than conventional dielectric materials having a similar dielectric constant.

While RF lenses provide a convenient mechanism for implementing sector-splitting, various difficulties may arise when trying to use lensed multi-beam antennas in practice. One such difficulty is that not all of the RF energy that is injected into the RF lens will pass through the RF lens as radiated RF energy. Consequently, the RF lens has an associated insertion loss that reduces the performance of the antenna. Moreover, the RF energy that fails to pass through the RF lens is, at least in part, converted to heat, which may cause the RF energy focusing material of the RF lens to heat up significantly. If sufficient heat builds up in the RF lens, the heat may alter the electromagnetic properties of the RF lens, degrading the performance of the antenna.

Additional issues may arise with lensed base station antennas that are based on the physical size of the RF lens structure. For lensed base station antennas operating in the 1.7-2.7 GHz frequency band, the RF lens typically has a diameter of 12 inches or more, which significantly increases the overall size of the antenna. Cellular operators generally prefer smaller antennas, and hence the increased size is a potential concern. Additionally, the increased size generally corresponds to increased material costs (e.g., a larger amount of dielectric material within the lens, a larger radome, etc.) and to increased weight (and hence tower loading). Accordingly, it may also be challenging to provided lensed sector-splitting base station antennas in a cost-effective manner.

Pursuant to embodiments of the present invention, lensed base station antennas are provided that include functional elements such as heat dissipation channels and/or an outer lens casing that are designed so that the RF lens structure will be a stepped approximation to a Luneberg lens. A Luneberg lens is a known type of RF lens that has a dielectric constant that continually decreases with increasing distance from a center of the lens according to a specific formula. A Luneberg lens may have various advantages as compared to other types of RF lenses including, for example the fact that an ideal Luneberg lens has a perfect focal point. An ideal Luneberg lens, however, cannot be fabricated, and step approximations of Luneberg lenses tend to be very expensive to manufacture. Accordingly, base station antennas having Luneberg lenses have not been deployed in significant quantities, and the use of RF lenses that are filled with an RF energy focusing material that has a homogeneous dielectric constant have been used instead.

An RF lens for a base station material, however, may include elements other than the RF energy focusing material. For example, the RF energy focusing material is often provided in the form of small cubes of material or as a flowable paste-like material. When such RF energy focusing material is used, the RF energy focusing material is typically contained within a lens casing that has the desired shape for the RF lens (e.g., a cylindrical lens casing for a cylindrical RF lens). The lens casing holds the RF energy focusing material in its proper place within the antenna so that the RF lens will focus transmitted and received RF energy in a desired fashion. Additionally, other functional elements may be included in the RF lens such as, for example, heat dissipation elements. Pursuant to embodiments of the present invention, functional elements of the RF lens such as the lens casing and/or the heat dissipation element may be designed so that the RF lens will be a three-step, a four-step or more approximation of a Luneberg lens by engineering the dielectric constant of these functional elements in a desired fashion. For example, a heat dissipation element may be provided in the center of the RF lens and designed to have a blended dielectric constant that is higher than the dielectric constant of the RF energy focusing material of the RF lens, while the lens casing of the RF lens may be designed to have a blended dielectric constant that is lower than the dielectric constant of the RF energy focusing material. Such an approach may, for example, configure the RF lens to be a four step approximation of a Luneberg lens.

According to some embodiments of the present invention, lensed base station antennas are provide that include (1) a first array of radiating elements that are configured to transmit respective sub-components of a first RF signal and (2) an associated RF lens. The RF lens includes a lens casing, an RF energy focusing material within the lens casing, and a first heat dissipation element that extends through the RF energy focusing material. The RF lens is configured to be at least a three step approximation of a Luneberg lens along a boresight pointing direction of the first array.

The first heat dissipation element may be a pipe that extends vertically through the RF lens when the base station antenna is mounted for use. The pipe may include a plurality of vertically-extending internal channels, at least some of which may be air-filled channels. A blended dielectric constant of the pipe and one or more materials that are within the internal channels of the pipe may exceed a dielectric constant of the RF energy focusing material. The lens casing may also include a plurality of internal channels. A blended dielectric constant of the lens casing and one or more materials that are within the internal channels of the lens casing may less than a dielectric constant of the RF energy focusing material.

Pursuant to further embodiments of the present invention, lensed base station antennas are provided that include a first array of radiating elements that are configured to transmit respective sub-components of a first RF signal and an RF lens positioned to receive electromagnetic radiation from the first array. The RF lens includes an outer lens casing that includes at least one air-filled internal channel and an RF energy focusing material within an interior of the outer lens casing. A blended dielectric constant of the outer lens casing is less than a dielectric constant of the RF energy focusing material. This may be achieved, for example, by including a plurality of air-filled internal channels in the outer lens casing.

Embodiments of the present invention will now be discussed in greater detail with reference to the attached figures, in which example embodiments are shown.

Figure 1B:
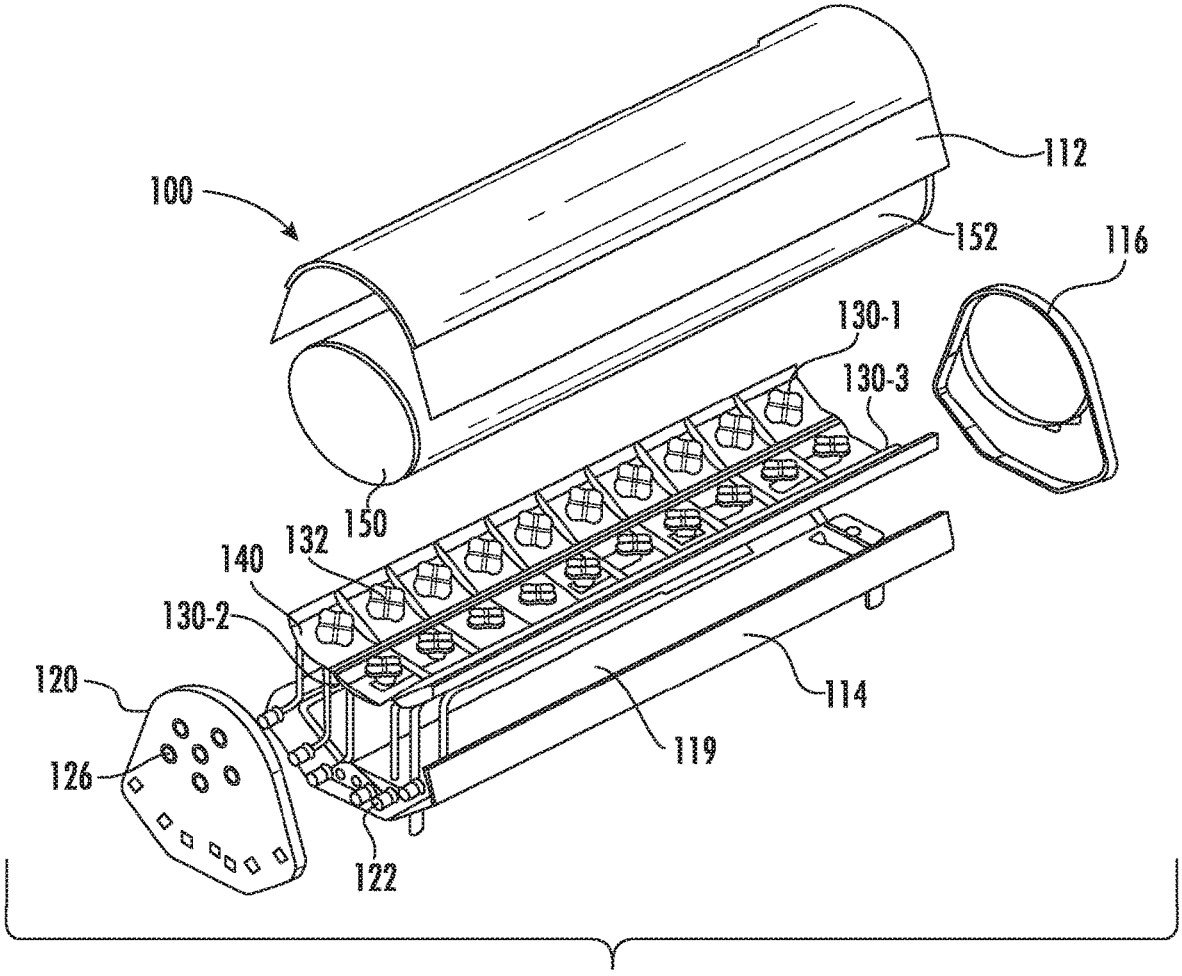
FIG. 1B is an exploded perspective view of the lensed multibeam base station antenna of FIG. 1A.
Figure 1C:
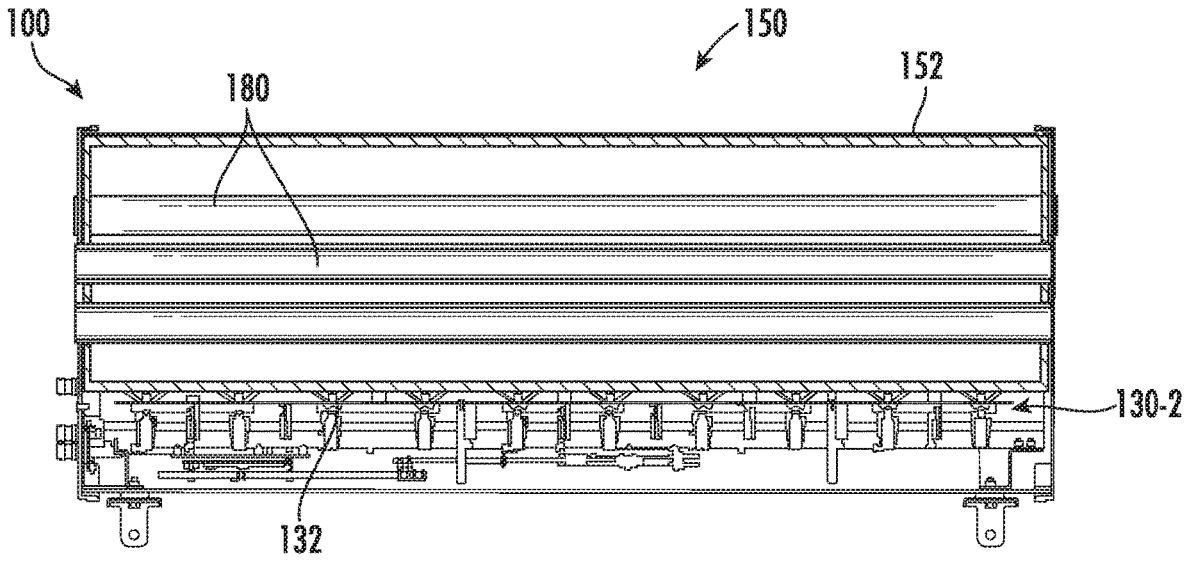
FIG. 1C is a longitudinal cross-sectional view of the base station antenna of FIGS. 1A-1B.
Figure 1D:
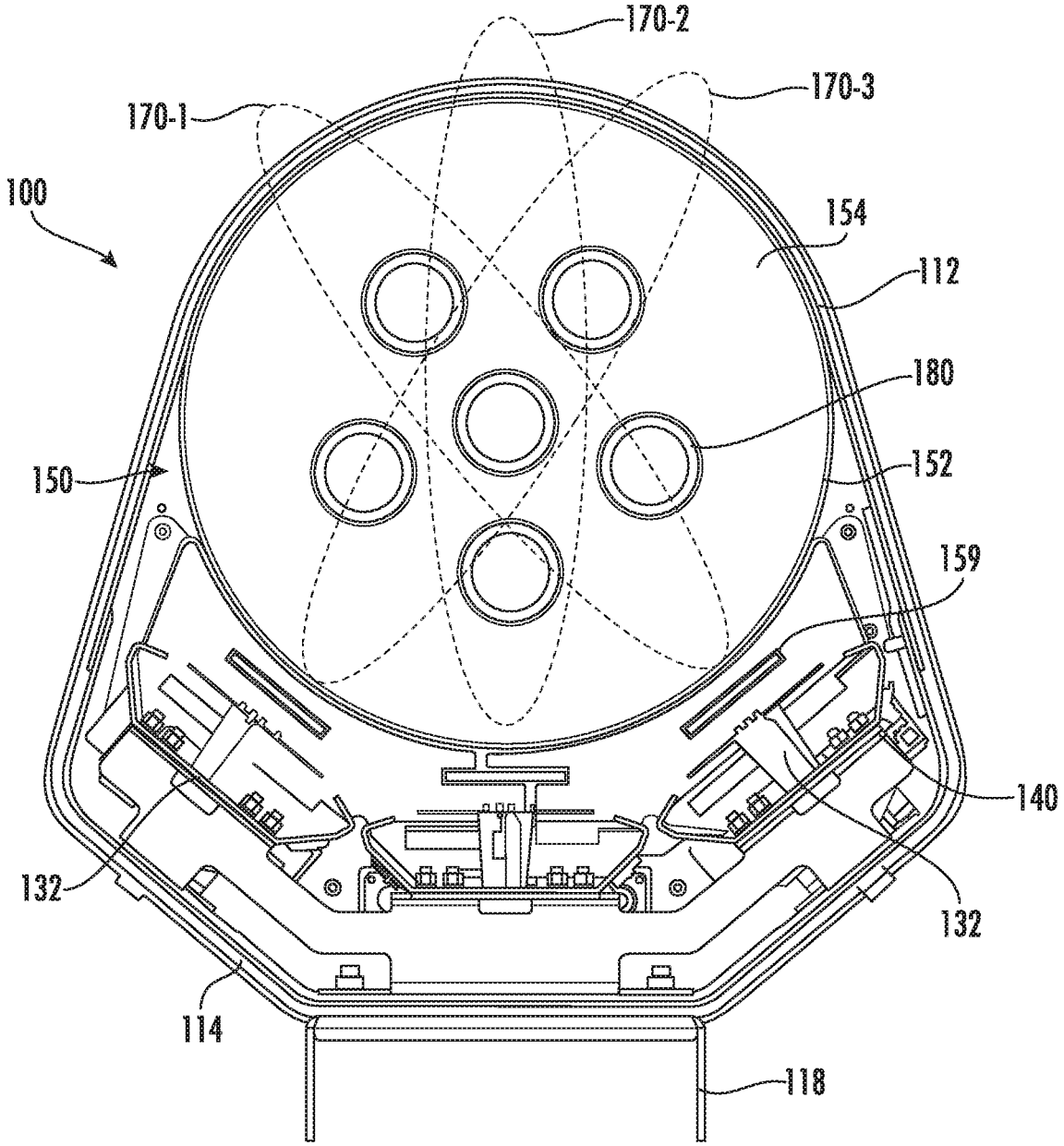
FIG. 1D is a transverse cross-sectional view of the base station antenna of FIGS. 1A-1C that schematically illustrates the antenna beams formed by the three linear arrays of radiating elements included in the antenna.
Figure 1E:
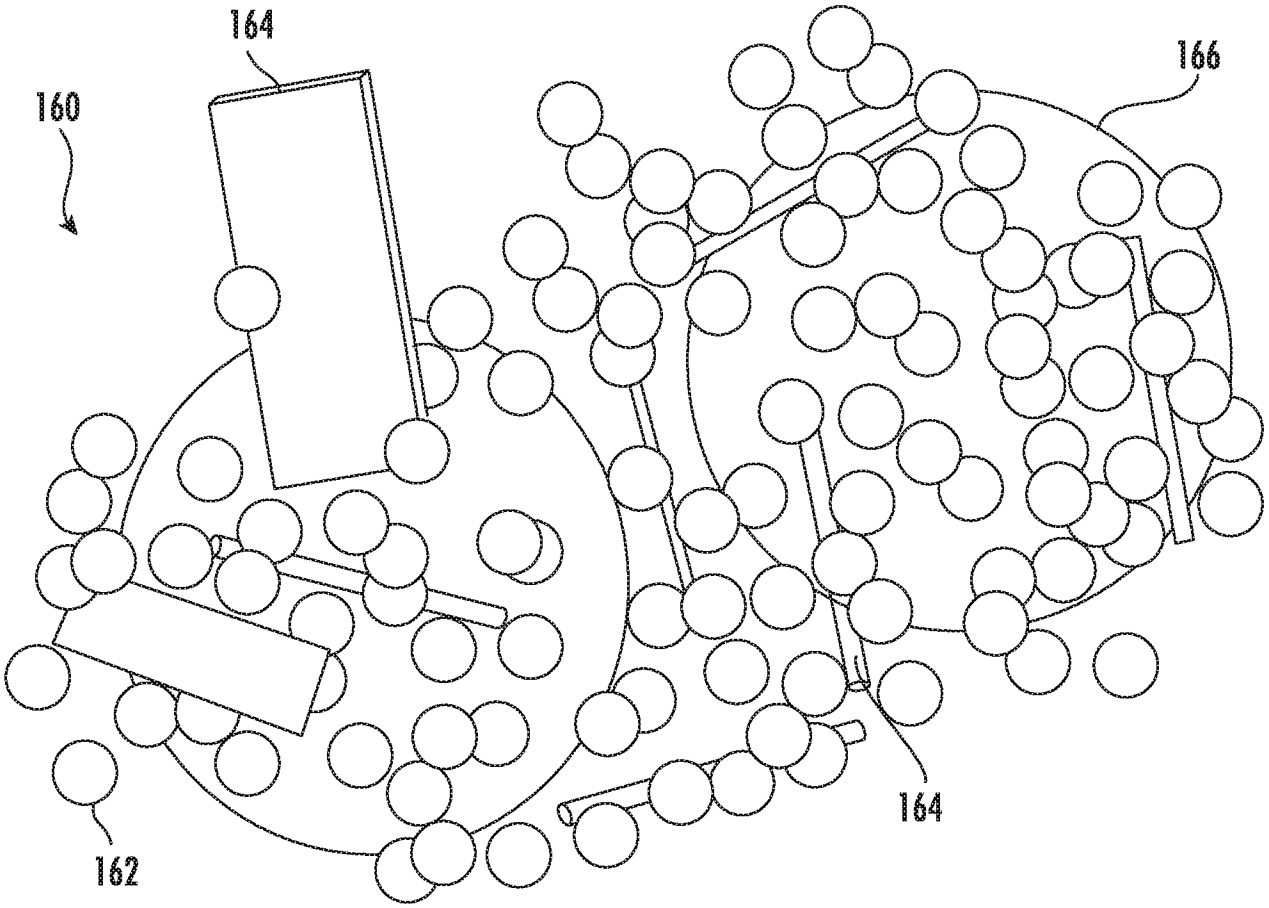
FIG. 1E is a schematic perspective view of an example composite dielectric material that may be used as the RF energy focusing material in the RF lens included in the base station antenna of FIGS. 1A-1D.

Reference is now made to FIGS. 1A-1E, which illustrate a lensed multibeam base station antenna 100 that includes heat dissipation elements. In particular, FIGS. 1A and 1B are a perspective view and an exploded perspective view, respectively, of the lensed multibeam base station antenna 100. FIG. 1C is a longitudinal cross-sectional view of the base station antenna 100 with the RF energy focusing material of the RF lens omitted, and FIG. 1D is a transverse cross-sectional view of the base station antenna 100 that schematically illustrates the antenna beams formed by the three linear arrays of radiating elements included in the antenna 100. Finally, FIG. 1E is a schematic perspective view of an example composite dielectric material that may be used as the RF energy focusing material in the RF lens included in the base station antenna of FIGS. 1A-1D.

Referring first to FIGS. 1A-1B, the lensed multibeam base station antenna 100 includes a housing 110. In the depicted embodiment, the housing 110 is a multi-piece housing that includes a radome 112, a tray 114, a top end cap 116 and a bottom end cap 120. Brackets 118 are mounted on the rear side of the tray 114 that may be used to mount the antenna 100 on an antenna mount structure. A plurality of RF ports 122 and control ports 124 may be mounted in the bottom end cap 120. The RF ports 122 may comprise RF connectors that may receive coaxial cables that provide RF connections between the base station antenna 100 and one or more radios (not shown). The control ports 124 may comprise connectors that receive control cables that may be used to send control signals to the antenna 100.

The radome 112, end caps 116, 120 and tray 114 may provide physical support and environmental protection to the antenna 100. The end caps 116, 120, radome 112 and tray 114 may be formed of, for example, extruded plastic, and may be multiple parts or implemented as a single piece. For example, the radome 112 and the top end cap 116 may be implemented as a monolithic element. In some embodiments, an RF absorber 119 can be placed between the tray 114 and the radiating elements (discussed below). The RF absorber 119 may help reduce passive intermodulation ("PIM") distortion that may be generated because the metal tray 114 and a metal reflector 140 (discussed below) may create a resonant cavity that generates PIM distortion. The RF absorber 119 may also provide back lobe performance improvement.

Referring to FIGS. 1B-1D, the base station antenna 100 further includes one or more linear arrays 130-1, 130-2, and 130-3 of radiating elements 132. Herein, when multiple of the same elements are included in an antenna the elements may be referred to individually by their full reference numeral (e.g., linear array 130-3) and collectively by the first part of their reference numerals (e.g., the linear arrays 130). While the radiating elements 132 included in each linear array 130 are illustrated in FIGS. 1B-1D as cross-polarized dipole radiating elements 132 that have four dipole arms mounted on feed stalk printed circuit boards that form a pair of slant −45°/+45° dipole radiators that emit RF energy with −45° and +45° polarizations, respectively, it will be appreciated that any appropriate radiating elements 132 may be used. For example, single polarization dipole radiating elements or patch radiating elements may be used in other embodiments.

While the antenna 100 includes three linear arrays 130, it will be appreciated that different numbers of linear arrays 130 may be used. For example, two or four linear arrays 130 may be used in other embodiments. It will also be appreciated that the antenna 100 may include additional linear arrays of radiating elements (not shown) that operate in different frequency bands. For example, additional linear arrays could be interleaved with the linear arrays 130 as shown, for example, in U.S. Pat. Nos. 7,405,710 and 9,819,094, both of which are incorporated herein by reference. This approach allows the lensed antenna to operate in two different frequency bands (for example, 696-960 MHz and 1.7-2.7 GHz).

As shown best in FIGS. 1B and 1D, each linear array 130 may be mounted to extend forwardly from a reflector 140. In the depicted embodiment, each linear array 130 includes a separate reflector 140, although it will be appreciated that a monolithic reflector 140 that serves as the reflector for all three linear arrays 130 may be used in other embodiments. Each reflector 140 may comprise a metallic sheet that serves as a ground plane for the radiating elements 132 and that also redirects forwardly much of the backwardly-directed radiation emitted by the radiating elements 132.

The antenna 100 further includes an RF lens 150. The RF lens 150 may be positioned in front of the linear arrays 130 so that the apertures of the linear arrays 130 point at a center axis of the RF lens 150. In some embodiments, each linear array 130 may have approximately the same length as the RF lens 150. When the antenna 100 is mounted for use, the azimuth plane is generally perpendicular to the longitudinal axis of the RF lens 150, and the elevation plane is generally parallel to the longitudinal axis of the RF lens 150.

The RF lens 150 may comprise or include an RF energy focusing material 154. In some embodiments, the RF energy focusing material 154 may be a dielectric material that has a generally homogeneous dielectric constant. The RF lens 150 may be formed of the RF energy focusing material 154 or may comprise a lens casing 152 (e.g., a hollow, light-weight shell) that is filled with the RF energy focusing material 154. The lens casing 152 may also be formed of a dielectric material and may also contribute to the focusing of the RF energy. In an example embodiment, the RF lens 150 may comprise a circular cylindrical lens casing 152 that may be filled with an RF energy focusing material 154 having a generally uniform dielectric constant. While the RF lens 150 comprises a circular cylinder, it will be appreciated that the RF lens 150 may have other shapes including a spherical shape, an ellipsoid shape, an elliptical cylinder shape and the like, and that more than one RF lens 150 may be included in the antenna 100.

The RF energy focusing material 154 included in the RF lens 150 may be a conventional lightweight dielectric material such as polystyrene, expanded polystyrene, polyethylene, polypropylene, expanded polypropylene. Alternatively, the RF energy focusing material may be a so-called "artificial" or "composite" dielectric material that includes metals, metal oxides or other materials that have the electromagnetic properties of high dielectric constant materials. Both types of material are referred to as "dielectric materials" herein.

FIG. 1E is a schematic perspective view of a composite dielectric material 700 that is one example of a composite dielectric material that may be used as the RF energy focusing material 154 in the RF lenses according to embodiments of the present invention. The composite dielectric material 160 includes expandable microspheres 162 (or other shaped expandable materials), conductive materials 164 (e.g., conductive sheet material), dielectric structuring materials 166 such as foamed polystyrene microspheres or other shaped foamed particles, and a binder (not shown) such as, for example, an inert oil.

The expandable microspheres 162 may comprise very small (e.g., 1-10 microns in diameter) spheres that expand in response to a catalyst (e.g., heat) to larger (e.g., 12-100 micron in diameter) air-filled spheres. These expanded microspheres 162 may have very small wall thickness and hence may be very lightweight. The small pieces of conductive sheet material 164 may have an insulating material on each major surface. The conductive sheet material 164 may comprise, for example, flitter (i.e., small flakes of thin sheet metal that has a thin insulative coating on both sides thereof). The dielectric structuring materials 166 may comprise, for example, equiaxed particles of foamed polystyrene or other lightweight dielectric materials such as expanded polypropylene. The dielectric structuring materials 166 may be larger than the expanded microspheres 162 in some embodiments. The dielectric structuring materials 166 may be used to control the distribution of the conductive sheet material 164 so that the conductive sheet material 164 has, for example, a suitably random orientation in some embodiments.

The microspheres 162, conductive sheet material 164, dielectric structuring materials 166 and binder may be mixed together and heated to expand the microspheres 162. The resulting mixture may comprise a lightweight, flowable paste that may be pumped or poured into a lens casing 154 to form the RF lens 150. The expanded microspheres 162 along with the binder may form a matrix that holds the conductive sheet material 164 and dielectric structuring materials 166 in place to form the composite dielectric material 160. The binder may generally fill the open areas between the expanded microspheres 162, the conductive sheet material 164 and the dielectric structuring materials 166 and hence is not shown separately in FIG. 1E for ease of illustration.

While FIG. 1E illustrates one RF energy focusing material 154 that may be used in the RF lenses according to embodiments of the present invention, it will be appreciated that this material is just one example of a suitable material. U.S. Patent Publication No. 2018/0166789, filed Jan. 29, 2018, the entire content of which is incorporated herein by reference, describes a wide variety of other suitable composite dielectric materials which may alternatively be used. Conventional lightweight dielectric materials may also be used such as, for example, foamed polystyrene or expanded polypropylene.

As is further shown in FIG. 1D, the multibeam base station antenna 100 may also include one or more secondary lenses 159. A secondary lens 159 can be placed between each linear array 130 and the RF lens 150. The secondary lenses 159 may facilitate azimuth beamwidth stabilization. The secondary lenses 159 may be formed of dielectric materials and may be shaped as, for example, rods, cylinders or cubes.

The base station antenna 100 further includes a plurality of heat dissipation elements 180. The heat dissipation elements 180 may comprise, for example, pipes that form heat dissipation channels 180. Some of the RF energy that is injected into the RF lens 150 by the radiating elements 132 will be converted to heat which may raise the temperature of the RF energy focusing material 154. Since the RF energy focusing materials 154 are typically dielectric materials, they tend to have low levels of thermal conductivity, and hence heat may build up in the RF lens 150. The heat can potentially be a significant problem in cases where the base station antenna 100 is operated at maximum power for extended periods of time, as the amount of temperature increase in such situations may be dramatic. The electromagnetic properties of the RF energy focusing material 154 may change at elevated temperatures, and if the temperatures are high enough, the RF energy focusing material 154 may even be permanently damaged.

Each heat dissipation channel 180 may be formed as a heat dissipation pipe 180 that is formed of a dielectric material such as plastic that extends through the RF lens 150. The heat dissipation pipes 180 may also extend through openings 126 in the bottom end cap 120 so that heat dissipation pipes 180 are open to the environment at the bottom of the antenna 100. While not visible in the drawings, the top end cap 116 may include similar openings 126 so that the heat dissipation pipes 180 may also extend through the top end cap 116. While the top end cap 116 and the radome 112 are shown as separate elements in the figures, it will be appreciated that in other embodiments they may be implemented together as a monolithic element. Waterproofing seals (not shown) may be included in one or both of the bottom end cap 120 and the top end cap 116 so that water or moisture cannot leak into the interior of the antenna 100 through the openings 126 in the end caps 116, 120 for the heat dissipation pipes 180. Having the heat dissipation pipes 180 extend all the way through the antenna 100 allows air to readily flow through the heat dissipation pipes 180 in order to vent heat from the interior of the RF lens 150.

The heat dissipation pipes 180 extend vertically though the RF lens 150. As such, heat that builds up within the interior of the RF lens 150 may pass into the heat dissipation pipes 180 and be vented from the antenna 100 by the flow of air through the heat dissipation pipes 180. While the RF lens 150 is shown as including a total of six heat dissipation pipes 180 passing therethrough, it will be appreciated that the number of heat dissipation pipes 180 used may be varied. In fact, in some embodiments, a single heat dissipation element that extends longitudinally through the center of the RF lens may be provided that is used to make the RF lens more closely approximate a Luneberg lens, as will be described in detail below.

Since the antenna 100 includes cross-polarized radiating elements 132, each linear array 130 may generate two antenna beams 170, namely an antenna beam 170 at each of the two polarizations. Three antenna beams 170-1, 170-2, 170-3 that are generated by the respective linear arrays 130-1, 130-2, 130-3 are illustrated schematically in FIG. 1E.

Only three antenna beams 170 are illustrated in FIG. 1E as the two antenna beams 170 formed at orthogonal polarizations by each linear array 130 may have substantially identical shapes and pointing directions. The centers of the antenna beams 170 formed by each linear array 130 are pointed at azimuth angles of −40°, 0°, and 40°, respectively. Thus, the three linear arrays 130 generate antenna beams 170 that together provide coverage to a 120° region in the azimuth plane.

As shown in FIG. 1E, all three of the antenna beams 170 pass though the longitudinal axis of the RF lens 150. As the RF energy that generates the antenna beams 170 is the cause of the heating of the RF energy focusing material 152 included in RF lens 150, significant heat may build up in the center of the RF lens 150. As shown in FIG. 1E, a first of the heat dissipation pipes 180 may extend along the longitudinal axis of the RF lens 150 and hence may be well-located to vent heat from the central region of the RF lens 150. The second through sixth heat dissipation pipes 180 are arranged to define a regular pentagon that surrounds the first heat dissipation pipe 180. As can also be seen in FIG. 1E, the three antenna beams 170 each intersect the central heat dissipation pipe 180. As such, the central heat dissipation pipe 180 is located in a region that may be particularly susceptible to heat build-up within the antenna 100.

While the heat dissipation pipes 180 are illustrated as having circular transverse cross-sections, it will be appreciated that embodiments of the present invention are not limited thereto. For example, in other embodiments the heat dissipation pipes 180 may have square, hexagonal, elliptical or other transverse cross-sections. Moreover, while the heat dissipation pipes 180 extend all the way through the antenna 100 in the depicted embodiment, in other embodiments, the heat dissipation pipes 180 may only extend through the bottom end cap 120 and not through the top end cap 116, which may enhance the waterproofing performance of the antenna 100.

The heat dissipation pipes 180 may be formed of any suitable material. For example, the heat dissipation pipes 180 may be formed using PVC pipes having, for example, sidewalls of between ⅛ and ¼ of an inch thick. Numerous other materials may be used. In embodiments where the heat dissipation pipes 180 extend all the way through the antenna 100 (and, in particular, in embodiments where the heat dissipation pipes 180 extend through the top end cap 116), it may be preferable that the pipes be impervious to water and moisture, as water may readily flow through the heat dissipation pipes 180.

The heat dissipation pipes 180 may be used to maintain the temperature of the RF energy focusing material 154 of RF lens 150 below levels where the RF energy focusing material 154 is damaged or at which the electromagnetic properties of the RF energy focusing material 154 is altered in a manner that materially impacts the performance of the RF lens 150.

The RF lens 150 may shrink the 3 dB beamwidth of each antenna beam 170-1, 170-2, 170-3 (see FIG. 1E) output by each linear array 130 from about 65° to about 23° in the azimuth plane. By narrowing the azimuth beamwidth of each antenna beam 170, the RF lens 150 increases the gain of each antenna beam 170 by, for example, about 4-5 dB. The higher antenna gains allow the multibeam base station antenna 100 to support higher data rates at the same quality of service. The multibeam base station antenna 100 may also reduce the antenna count for the base station.

As discussed above, the RF lens 150 included in base station antenna 100 has a lens casing 152 that is filled with RF energy focusing material 154 that has a homogeneous dielectric constant. Another type of RF lens that has been proposed for use in base station antennas is the Luneberg lens, which is a lens that includes multiple layers of dielectric material where each layer has a different dielectric constant. The dielectric materials in the layers closest to the center of the lens have higher dielectric constants, while the dielectric materials in the layers farther from the center of the lens have steadily decreasing dielectric constants. Optimally, a Luneberg lens has a dielectric constant that conforms to the following formula:

$$Dk=2*[1-(r/R)^2] \quad (1)$$

where Dk is the dielectric constant, R is the radius of the Luneberg lens and r is a particular location along the radius R.

One drawback of an RF lens having a homogeneous dielectric constant is that it does not have a perfect focal point. In contrast, an ideal Luneberg lens has a perfect focal point due to the continuous variation of the internal dielectric constant of the lens.

Figure 2A:
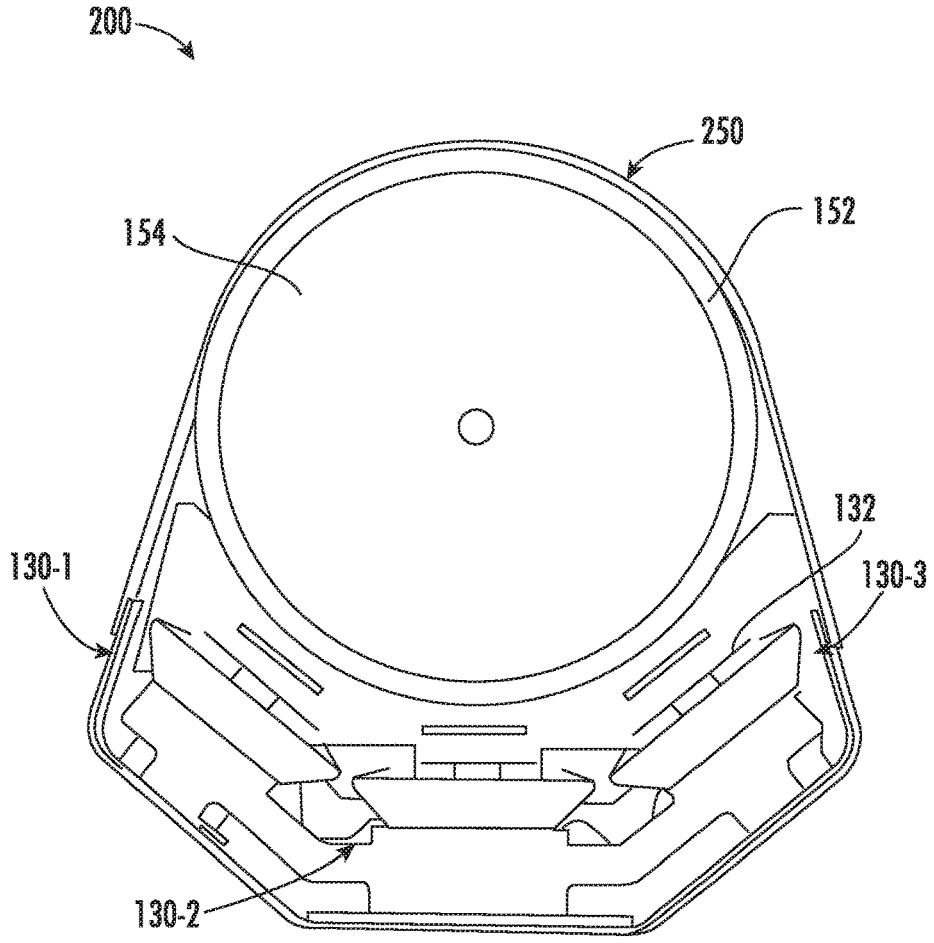
FIG. 2A is a schematic cross-sectional view of a base station antenna having an RF lens that is filled with RF energy focusing material that has a homogeneous dielectric constant.

FIG. 2A is a schematic cross-sectional view of such a conventional base station antenna 200. The base station antenna 200 includes three linear arrays 130-1 through 130-3 of radiating elements 132 and an RF lens 250 that comprises a lens casing 152 that is filled with an RF energy focusing material 154 that has a homogeneous dielectric constant. The RF energy focusing material 154 may be a composite dielectric material that has a relatively high dielectric constant (e.g., a dielectric constant in the range of 1.6 to 2.5) while being low cost, stable and relatively lightweight. The lens casing is typically made of a plastic material such as polyethylene or polypropylene and may have a dielectric constant in, for example, the range of 2.0-2.3, although materials with higher dielectric constants such as polycarbonate, polyvinyl chloride ("PVC") or acrylonitrile butadiene styrene ("ABS") may be used. The lens casing 152 is typically made as thin as possible while providing a desired amount of structural support and rigidity.

In the particular embodiment illustrated in FIG. 2A, the RF lens 250 is a cylindrical RF lens having a diameter of 200 mm (100 mm radius) with a 28 mm air gap between the outer surface of the RF lens 250 and each linear array 130. The RF energy focusing material 154 included in RF lens 250 has a dielectric constant of 1.8, and is assumed that the lens casing 152 also has a dielectric constant of 1.8. The air between the RF lens 250 and the linear array 130 (which is located at the focal point of the RF lens) has a dielectric constant of 1.0.

The focal point for an RF lens is outside of the RF lens at a point known as the lens cortex. Consequently, the base station antenna 200 may be viewed as a two-step approximation of a Luneberg lens, even though the RF lens 250 is filled with RF energy absorbing material 154 that has a purely homogeneous dielectric constant, since the RF energy focusing material 154 of the RF lens 250 has a first dielectric constant and the air-filled region between the outer surface of the RF lens 250 and the focal point has a second dielectric constant that is lower than the first dielectric constant. The manner in which base station antenna 200 is a two-step approximation of a Luneberg lens is shown graphically in FIG. 2B, which is a plot of the dielectric constant of the material between the center of the RF lens 250 and a linear array 130 of radiating elements 132 of antenna 200.

Figure 2B:
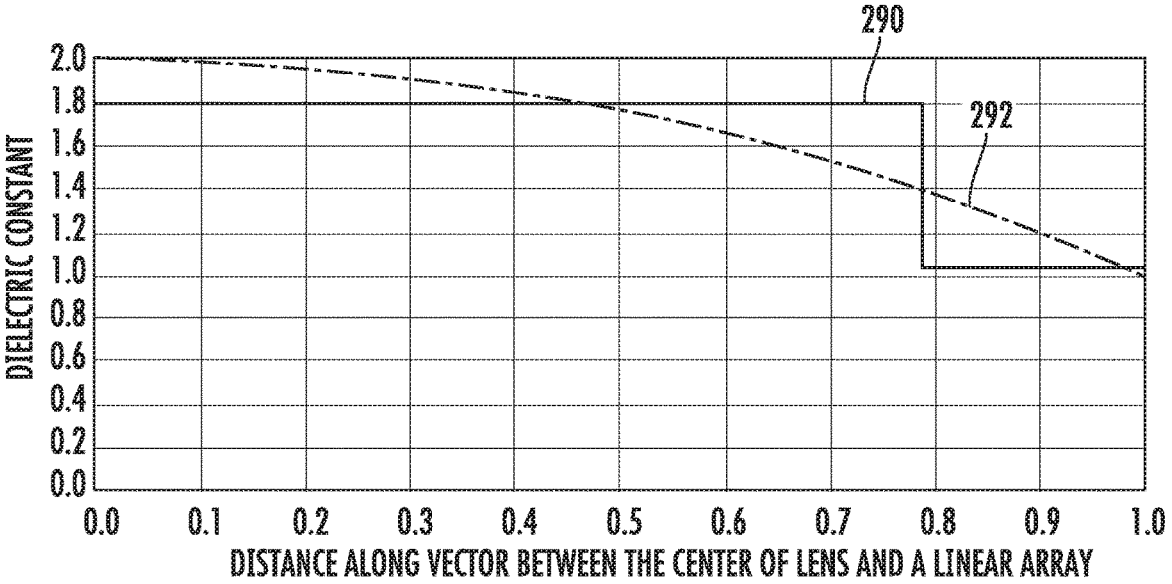
FIG. 2B is a graph illustrating the dielectric constant of the RF lens of the base station antenna of FIG. 2A along a vector extending from a center of the RF lens of the antenna.

As shown by curve 290 in FIG. 2B, the dielectric constant of the material between the center of the RF lens 250 and the lens casing 152 of the RF lens 250 along a vector extending from the center of the RF lens 250 toward the linear array 130 is 1.8, which is the dielectric constant of the RF energy focusing material 154 included in RF lens 250. Curve 290 in FIG. 2B also shows that the air between the RF lens 250 and the linear array 130 (which is located at the focal point of the RF lens) has a dielectric constant of 1.0. FIG. 2B also includes a curve 292 that illustrates the dielectric constant as a function of distance from the center of the RF lens for an ideal Luneberg lens. By comparing curves 290 and 292 in FIG. 2B, it can be seen that the RF lens 250 having RF energy focusing material 154 that has a homogeneous dielectric constant provides a very rough approximation of a Luneberg lens.

Pursuant to embodiments of the present invention, lensed base station antennas are provided that use functional elements of the RF lens to provide a better approximation of a Luneberg lens. The functional elements of the RF lens that may be used to provide the enhanced approximation may include, for example, heat dissipation elements such as air channels that are used to vent heat from the interior of the RF lens and/or the lens casing that holds the RF energy focusing material of the RF lens. The RF lenses according to some embodiments of the present invention may include a single filler material that has a homogeneous dielectric constant that serves as the primary RF energy focusing material of the RF lens, but may also include structural and/or functional elements formed of materials having other dielectric constants that are used to provide an enhanced step approximation of a Luneberg lens.

Figure 3A:
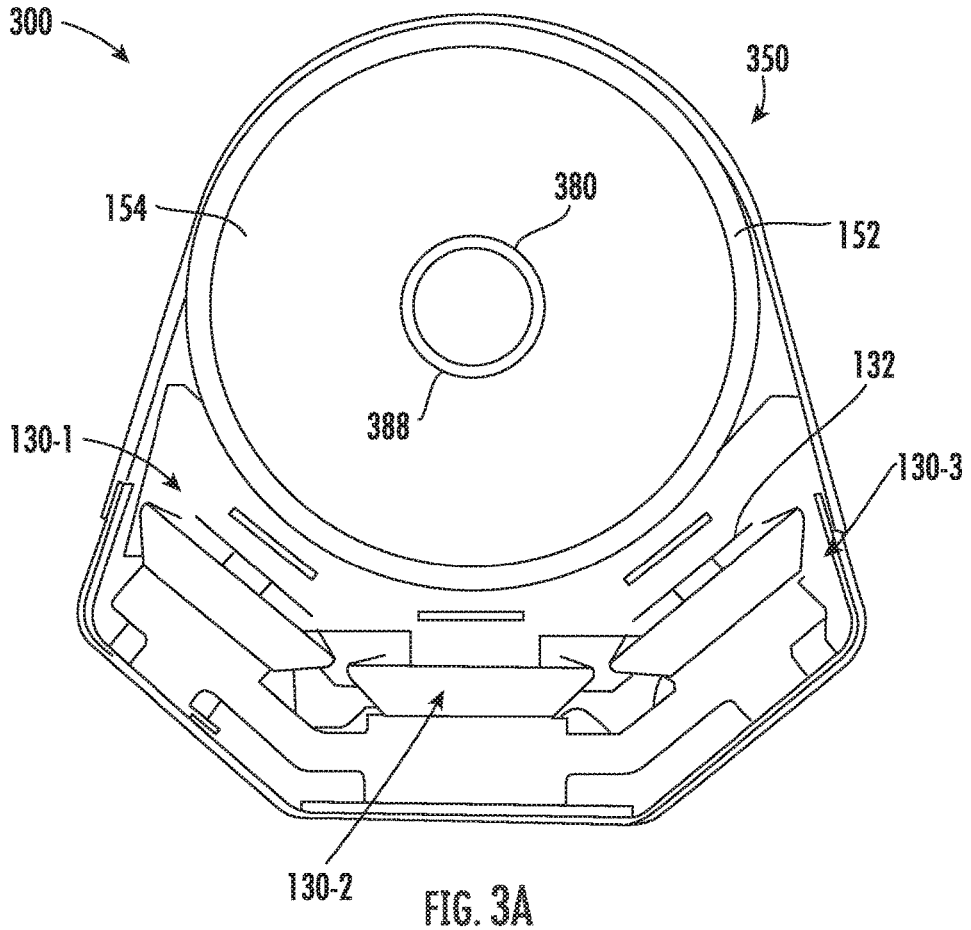
FIG. 3A is a schematic cross-sectional view of a base station antenna having an RF lens with a single heat dissipation pipe.

FIG. 3A is a schematic cross-sectional view of a base station antenna 300 according to embodiments of the present invention that has an RF lens 350 with a single large heat dissipation pipe. The base station antenna 300 may be identical to the base station antenna 100 discussed above except that the six heat dissipation elements 180 of antenna 100 are replaced with the single heat dissipation element 380 in antenna 300. As shown in FIG. 3A, the heat dissipation element 380 is in the form of a heat dissipation pipe 380 having an outer wall 388 that extends along the longitudinal axis of the RF lens 350. The heat dissipation pipe 280 may have, for example, an outer diameter of between 1.5 and 4.5 inches and a thickness of between ⅛ of an inch and ⅓ of an inch. The heat dissipation pipe 380 may be formed of PVC having a dielectric constant of, for example, between about 3.2 and 3.5.

The dielectric constant of the heat pipe 380, as seen by RF energy transmitted by linear array 130, will comprise a blend of the dielectric constant of the PVC material used to form the heat dissipation pipe 380 and the air within the interior of the heat dissipation pipe 380. By selecting the outer and inner diameters of the pipe 380, the heat dissipation pipe 380 may be designed to have a blended dielectric constant that exceeds 1.8. In the embodiment of FIG. 3A, the heat dissipation pipe 380 is designed to have a blended dielectric constant of about 2.0.

Figure 3B:
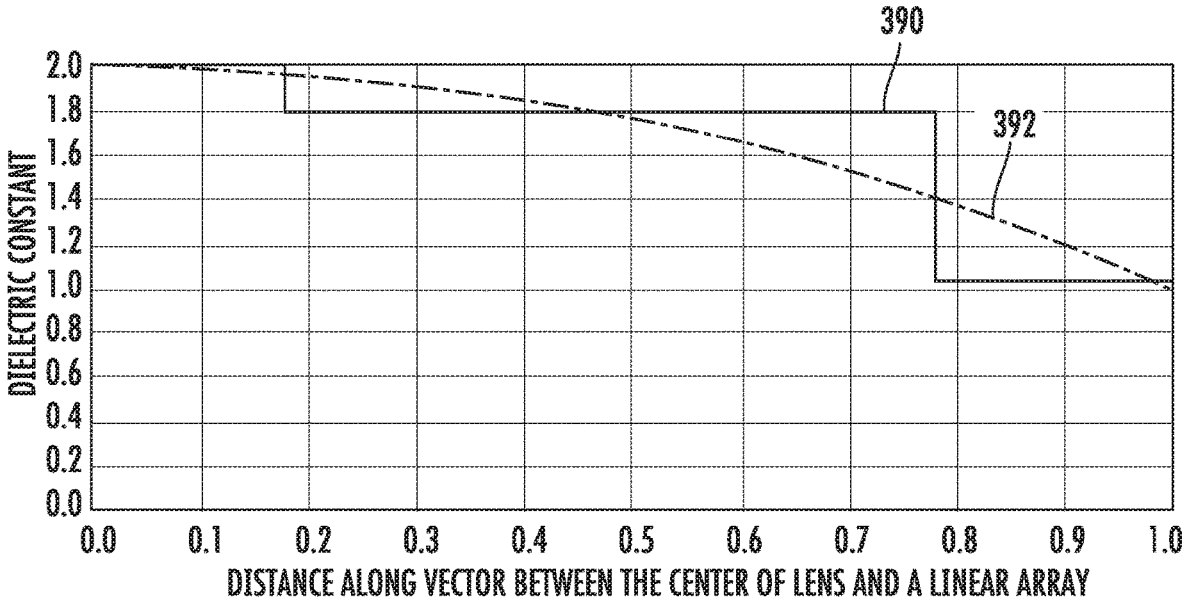
FIG. 3B is a graph illustrating the dielectric constant of the RF lens of the base station antenna of FIG. 3A along a vector extending from a center of the RF lens of the antenna.

FIG. 3B is a graph illustrating the dielectric constant of the RF lens 350 of the base station antenna 300 of FIG. 3A along a vector extending from the center of the RF lens 350 to the linear array 130-2 of antenna 300. As shown in FIG. 3B, the RF lens 350 may use the heat dissipation pipe 380 to provide a three-step approximation of a Luneberg lens. As can be seen by comparing FIGS. 2B and 3B, the three-step approximation more closely approximates the dielectric constant profile for an ideal Luneberg lens, and hence the RF lens 250 may exhibit improved performance, particularly in terms of more tightly focusing the RF energy around a focal point, providing deeper nulls and lower sidelobes in the far field radiation pattern, and in the size of the lens required to obtain a given half power beamwidth.

RF lens 350 includes a heat dissipation pipe 380 having a thick outer wall. This thick wall may potentially degrade the heat dissipation performance of base station antenna 300, as heat may not flow well through the thick PVC wall into the interior of the heat dissipation pipe 380. Accordingly, in other embodiments, the heat dissipation pipe 380 may be modified to include internal channels that may provide structural support and/or the appropriate dielectric constant.

Figure 4A:
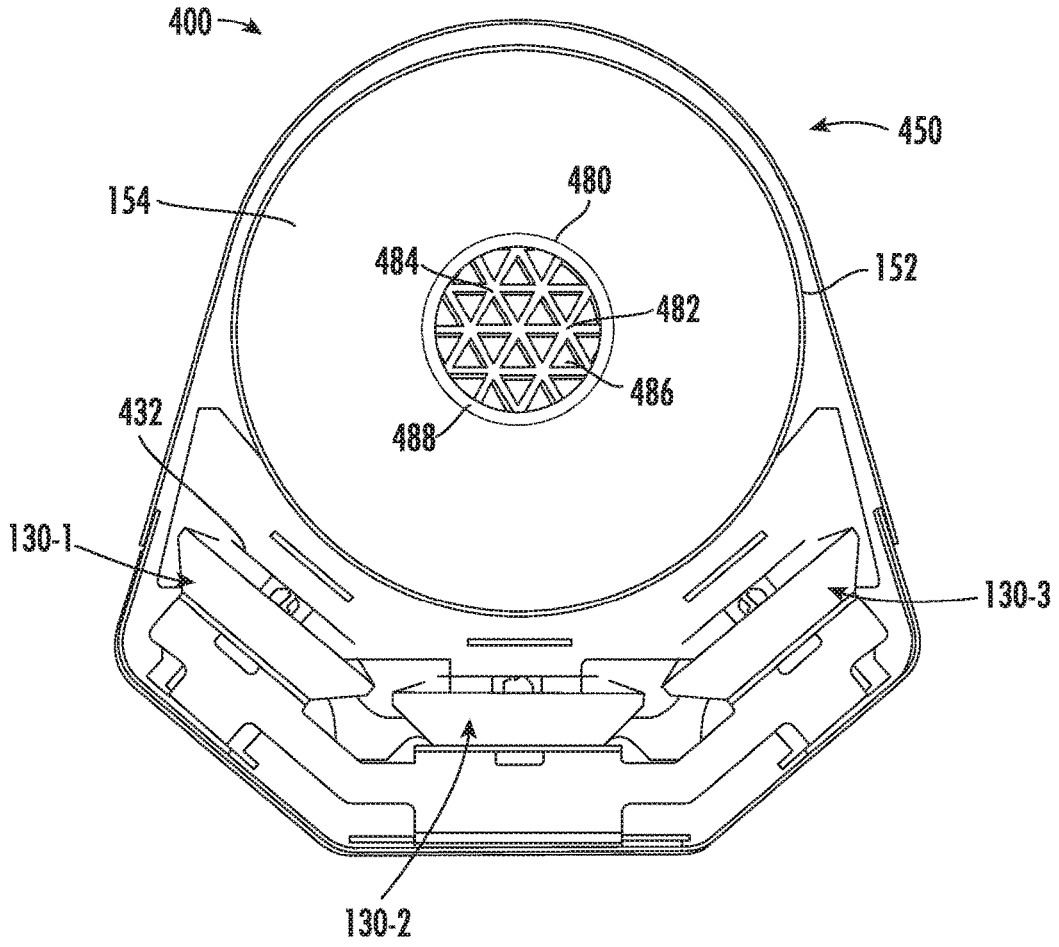
FIG. 4A is a schematic cross-sectional view of a base station antenna having an RF lens with a single large heat dissipation pipe that includes a grating that defines a plurality of internal channels within the heat dissipation pipe.

For example, FIG. 4A is a schematic cross-sectional view of a base station antenna 400 according to further embodiments of the present invention that has an RF lens 450 with a single large heat dissipation pipe 480 that includes an internal support structure 482 in the form of a plurality of longitudinally-extending walls 484 that define a plurality of internal channels 486 within the heat dissipation pipe 480.

The base station antenna 400 may be identical to the base station antenna 300 discussed above except that the heat dissipation element 380 of antenna 300 is replaced with the heat dissipation element 480 in antenna 400. The outer wall 488 of heat dissipation element 480 may be thinner than the outer wall 388 of heat dissipation pipe 380 of antenna 300, as the internal support structure 482 may provide structural support, which may allow the outer wall of the heat pipe 480 to be made much thinner while still providing sufficient rigidity and structural strength. The internal support structure 482 may comprise, for example a plurality of interconnected, longitudinally-extending walls 484 of PVC material that extend through the interior of the heat dissipation pipe 480.

The blended dielectric constant of the heat dissipation pipe 480 will comprise a blend of the dielectric constant of the PVC material used to faint the heat dissipation pipe 480 (including the internal support structure 482 thereof) and the material within the internal channels 486 of the heat dissipation pipe 480. In some embodiments, the material within the internal channels 486 may be air (dielectric constant 1.0). In such embodiments, if the RF lens 450 is configured so that RF energy radiated by the radiating elements 132 of the linear arrays 130 will pass through about 40% PVC material and about 60% air when traversing the RF lens 450, the blended dielectric constant of the heat dissipation pipe 480 will be about 2.0.

Figure 4B:
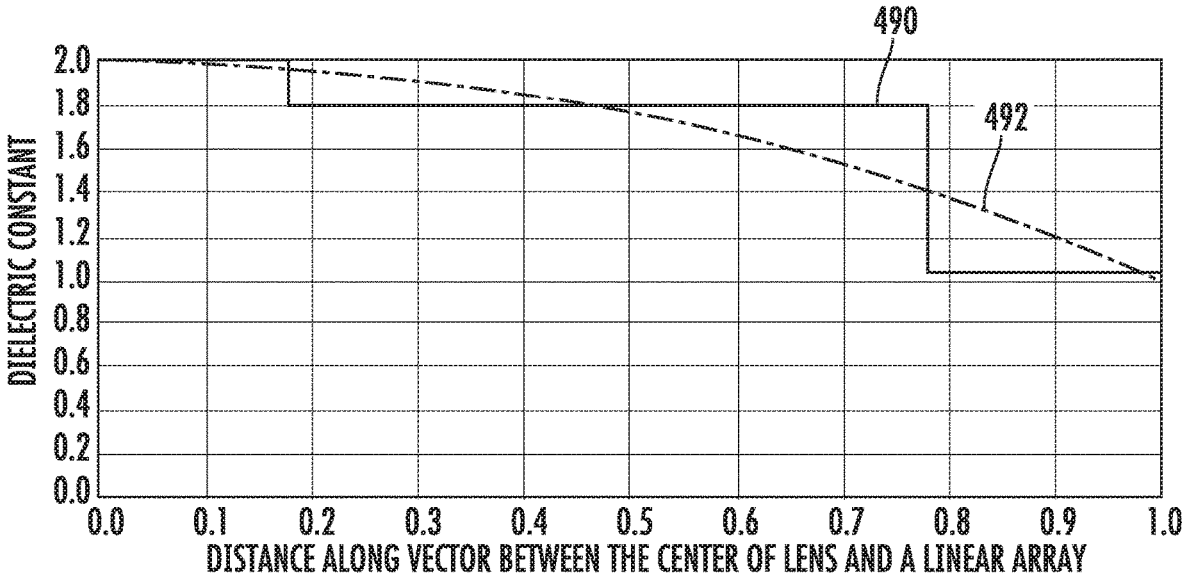
FIG. 4B is a graph illustrating the dielectric constant of the RF lens of the base station antenna of FIG. 4A along a vector extending from a center of the RF lens of the antenna.

FIG. 4B is a graph illustrating the dielectric constant of the RF lens 450 of the base station antenna 400 of FIG. 4A along a vector extending from the center of the RF lens 450 to a linear array 130-1 of antenna 400. As shown in FIG. 4B, the RF lens 450 may use the heat dissipation pipe 480 to provide a three-step approximation of a Luneberg lens that may be essentially identical to the three-step approximation provided by the RF lens 350 of FIG. 3A.

While in some embodiments all of the internal channels 486 in the heat dissipation pipe 480 may be filled with air, embodiments of the present invention are not limited thereto. For example, in other embodiments, at least some of the internal channels 486 may be filled with, for example, the same RF energy focusing material 154 that is used to fill the remainder of the RF lens 450. As the RF energy focusing material 154 may have a dielectric constant of, for example, about 1.8, less PVC material may be required to configure the heat dissipation pipe 450 to have a blended dielectric constant of, for example, 2.0. As PVC may be significantly heavier than the RF energy focusing material 154, this may facilitate reducing the weight of the RF lens 450. Moreover, while the interior channels 486 of heat dissipation pipe 450 that are filled with the RF energy focusing material 154 may not efficiently dissipate heat from the interior of the RF lens 450, the vast majority of the heat dissipation is provided by the outer channels 486 that are adjacent the RF energy focusing material 154. As such, filling some of the interior channels 486 may have little impact on the heat dissipation capabilities of the heat dissipation pipe 480. Moreover, since the RF lens 450 requires less PVC material to provide a desired blended dielectric constant value (e.g., a dielectric constant of 2.0), the outer wall 488 of the heat dissipation pipe 480 may be made thinner in embodiments that include some interior channels 486 that are filled with RF energy focusing material 154, and hence heat may pass more readily through the outer wall 488 of the heat dissipation pipe 480 into the air-filled channels 486. Thus, in some cases it may even be possible to improve the overall heat dissipation performance of the RF lens 450 while at the same time using less PVC material, and hence reducing the weight of the RF lens 450.

Pursuant to further embodiments of the present invention, the lens casing may also be used to adjust the dielectric constant of the RF lens in a favorable manner to, for example, approximate a Luneberg lens. In order to accomplish this, the lens casing may be formed of materials that have a blended dielectric constant that is lower than the dielectric constant of the RF energy focusing material that comprises the primary filler of the RF lens.

Figure 5A:
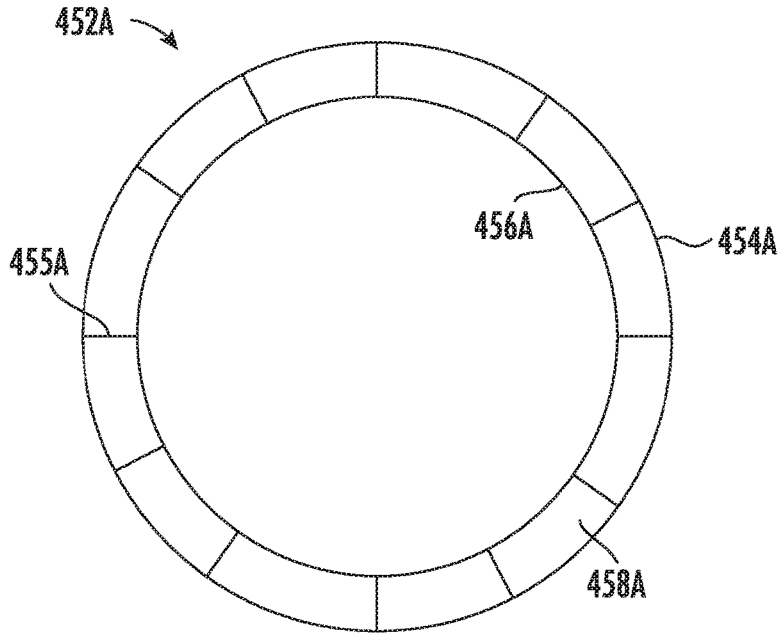
FIG. 5A is a transverse cross-sectional view of a lens casing for a cylindrical RF lens according to embodiments of the present invention.

FIG. 5A is a transverse cross-sectional view of a lens casing 452A for a cylindrical RF lens according to embodiments of the present invention that may have a dielectric constant that is lower than the dielectric constant of the RF energy focusing material included in the RF lens. Typically, the materials used to form lens casings have a dielectric constant of 2.0 or more. Thus, as shown in FIG. 5A, to lower the dielectric constant of the lens casing 452A, a plurality of air-filled longitudinally-extending internal channels 458A may be provided that are used to lower the dielectric constant of the lens easing 452A. In particular, the lens casing 452A includes an outer wall 454A, and an inner wall 456A, and the air-filled internal channels 458A are defined therebetween. Radial segments 455A divide the interior of the lens casing 452A into the plurality of air-filled longitudinally-extending channels 458A. The lens casing 452A may be used, for example, in place of the lens casing 152 illustrated in FIGS. 3A and 4A.

Figure 5B:
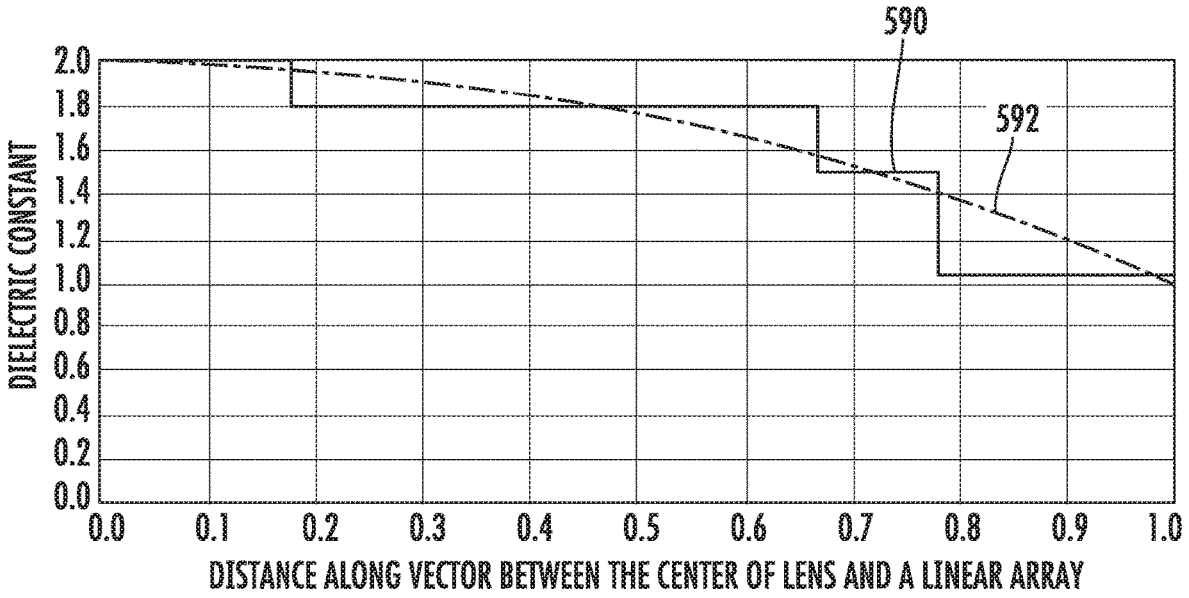
FIG. 5B is a graph illustrating the dielectric constant of the RF lens of the base station antenna of FIG. 4A modified to have the lens casing of FIG. 5A along a vector extending from a center of the RF lens of the antenna.

FIG. 5B is a graph illustrating the dielectric constant of the RF lens 450 of the base station antenna 400 of FIG. 4A modified to have the lens casing 452A of FIG. 5A. In particular, curve 590 in the graph of FIG. 5B illustrates the dielectric constant of the modified version of RF lens 450 (which will be referred to herein as RF lens 450A) along a vector extending from a center of the RF lens 450A to a linear array 130 of the antenna, while curve 592 shows the dielectric constant along the same vector for an ideal Luneberg lens. As shown in FIG. 5B, the RF lens 450A may provide a four-step approximation of a Luneberg lens that may provide a better approximation to a Luneberg lens than the three-step approximations shown in FIGS. 3B and 4B.

Figure 5C:
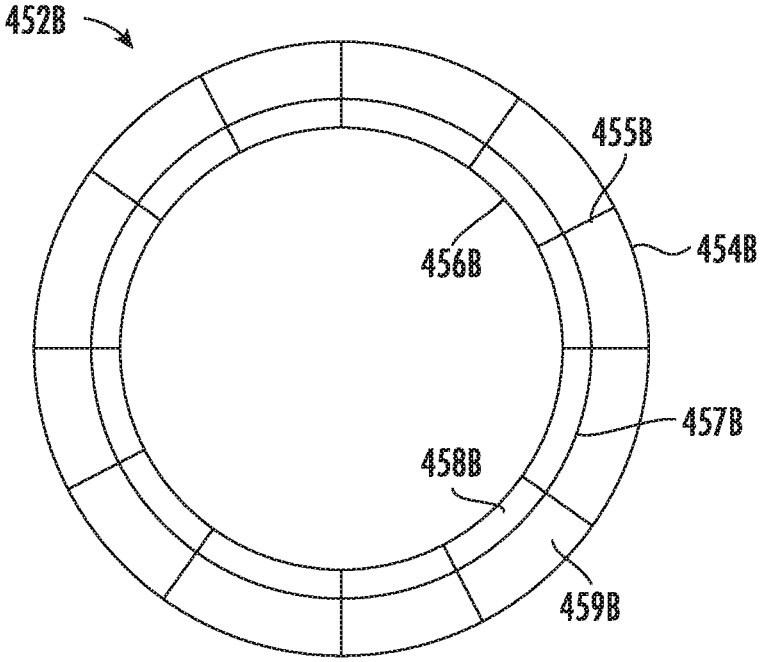
FIG. 5C is a transverse cross-sectional view of a lens casing according to further embodiments of the present invention that may be used in place of the lens casing of FIG. 5A.

FIG. 5C is a transverse cross-sectional view of a lens casing 452B according to further embodiments of the present invention that may be used in place of the lens casing 452A of FIG. 5A. As shown in FIG. 5C, the lens casing 452B includes an outer wall 454B, an inner wall 456B and an intermediate wall 457B, each of which are in the form of an open cylinder having a circular transverse cross-section. Radial segments 455B divide the interior of the lens casing 452B into a plurality of longitudinally-extending channels that include inner channels 458B and outer channels 459B. Each longitudinally-extending channel 458B, 459B may be filled with air. The outer channels 459B are larger than the inner channels 458, and hence the blended dielectric constant for the inner portion of the lens casing 452B is larger than the blended dielectric constant for the outer portion of the lens casing 452B. As a result, a base station antenna having the lens casing 452B may be viewed as a five-step approximation of a Luneberg lens. The lens casing 452B may have good structural strength and rigidity, and may also have a low blended dielectric constant due to the multiple layers of air-filled channels 458B, 459B. For example, if each wall 454B, 456B, 457B has a thickness of about 1 mm and is formed of PVC having a dielectric constant of about 3.2-3.5, the dielectric constant of the inner portion of the lens casing may be about 1.45 and the dielectric constant of the outer portion of the lens casing may be about 1.2. It will be appreciated that a wide variety of lens casing designs may be used to provide a lens casing having a blended dielectric constant that is less than the dielectric constant of the RF energy focusing material included within the lens casing.

The lens casings according to embodiments of the present invention, such as lens casings 452A and 452B, may be formed of a relatively low weight dielectric material such as, for example, polyethylene or polypropylene (dielectric constant of about 2.2), that has a lower dielectric constant. However, materials with higher dielectric constants such as polycarbonate, PVC or ABS (dielectric constants of about 3.0-3.4) may also be used, and may even be preferred, as they may allow a target dielectric constant to be achieved with less weight. The radial members 455A, 455B may help provide the necessary structural strength and rigidity. The lens casings 452A, 452B may be easy to extrude and hence may be formed inexpensively, while at the same time helping to improve the overall performance of the base station antenna.

Figure 6:
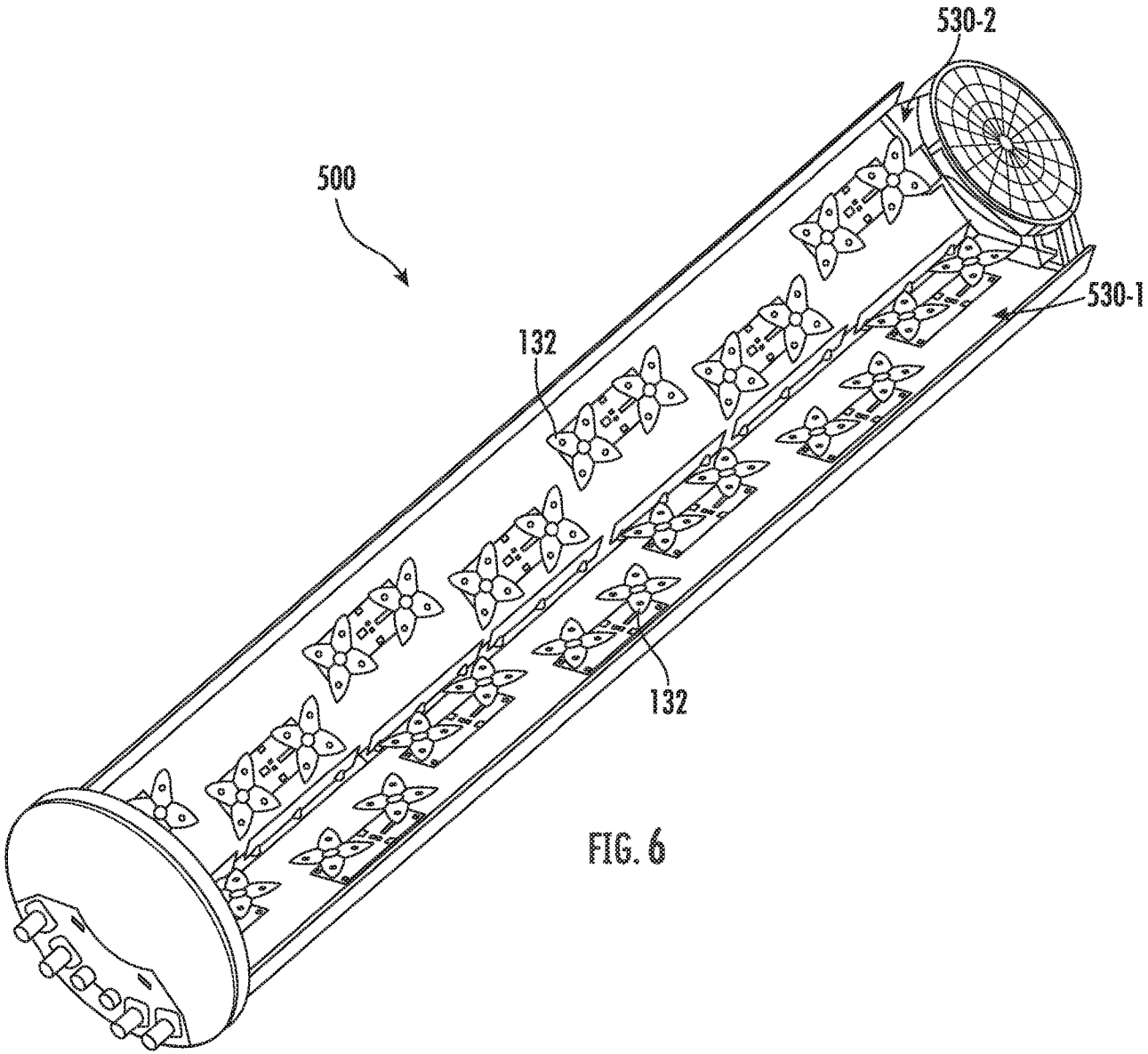
FIG. 6 is a schematic perspective view of a lensed multibeam base station antenna that includes two linear arrays of radiating elements with the RF lens and the radome of the antenna omitted.

While the above-discussed base station antennas according to embodiments of the present invention each include three linear arrays of radiating elements, it will be appreciated that embodiments of the present invention are not limited thereto. For example, FIG. 6 is a schematic perspective view of a lensed multibeam base station antenna 500 that includes two linear arrays 530-1, 530-1 of radiating elements 132 as opposed to the three linear arrays 130-1 through 130-2 included in the base station antennas that are discussed above. In FIG. 6, the radome and RF lens for base station antenna 500 are omitted in order to better illustrate the two linear arrays 530-1, 530-2 of radiating elements 132. As can be seen, each linear array 530 comprises a staggered linear array where the radiating elements 132 thereof are not perfectly aligned along a single vertical axis, but instead the radiating elements 132 are staggered a small amount in the transverse direction. As explained in U.S. Provisional Patent Application Ser. No. 62/722,238, filed Aug. 24, 2018, the entire content of which is incorporated herein by reference, such staggering of the radiating elements 132 may be used to adjust the azimuth beamwidth of the antenna beams generated by each linear array 530. It will be appreciated that above-discussed RF lenses 150, 350 or 450 could be used in base station antenna 500. It will also be appreciated that any of RF lenses 150, 350 or 450 could be further modified to have lens casing 452A of FIG. 5A or the lens casing 452B of FIG. 5C as opposed to lens casing 152.

As discussed above with reference to FIG. 4A, it may be advantageous to use a heat dissipation pipe (or other heat dissipation element) that has a relatively thin outer wall in order to facilitate dissipating heat from the RF energy focusing material 154 of the RF lens 450. Accordingly, the thickness of the outer wall 488 of the heat dissipation pipe 480 may be reduced, and an internal support structure 482 may be provided in the interior of the heat dissipation pipe 480 that provides structural rigidity and/or that are used to increase the blended dielectric constant of the heat dissipation pipe 480 to a desired level. While FIG. 4A illustrates a heat dissipation pipe 480 having an internal support structure 482 in the form of a plurality of longitudinally-extending walls 484 that define a plurality of internal channels 486 having triangular (or nearly triangular) transverse cross-sections, it will be appreciate that the heat dissipation pipes according to embodiments of the present invention are not limited thereto. For example, FIGS. 7A-7C are schematic transverse cross-sectional views of three base station antennas 500A, 500B, 500C that have the general design of base station antenna 500 of FIG. 6, but each has a different RF lens (550A, 550B, 550C) that includes respective heat dissipation pipes (580A, 580B, 580C) that have alternate example internal support structures (582A, 582B, 582C).

Figure 7A:
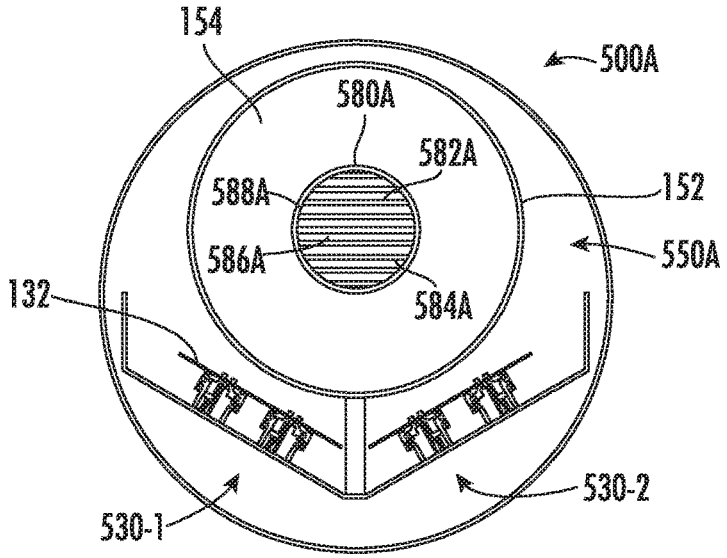
FIGS. 7A-7C are schematic transverse cross-sectional views of RF lenses according to further embodiments of the present invention.

For example, as shown in FIG. 7A, base station antenna 500A includes an RF lens 550A that has a heat dissipation pipe 580A that includes an internal support structure 582A in the form of a plurality of longitudinally-extending walls 584A. The outer wall 588A of heat dissipation pipe 580A in conjunction with the longitudinally-extending walls 584A defines a plurality of internal channels 586A. Each internal channel 586A may be an air-filled channel. The heat dissipation pipe 580A may be advantageous in that RF energy transmitted by the linear arrays 530-1, 530-2 may generally pass through about the same amount of the material used to form the internal support structure 582A, and hence the RF energy will generally be subject to about the same amount of focusing. Additionally, the heat dissipation pipe 580A may define relatively large internal channels 586A, which may more effectively dissipate heat from the RF energy focusing material 154 included in RF lens 550A. However, the heat dissipation characteristics of heat dissipation pipe 580A are not very uniform. In particular, heat dissipation pipe 580A will dissipate heat more efficiently from side areas of the RF lens 550A as compared to from front and back portions of the RF lens 550A, and the internal support structure 582A may also not provide as much structural support as various of the other internal support structures disclosed herein (assuming constant wall thickness).

Figure 7B:
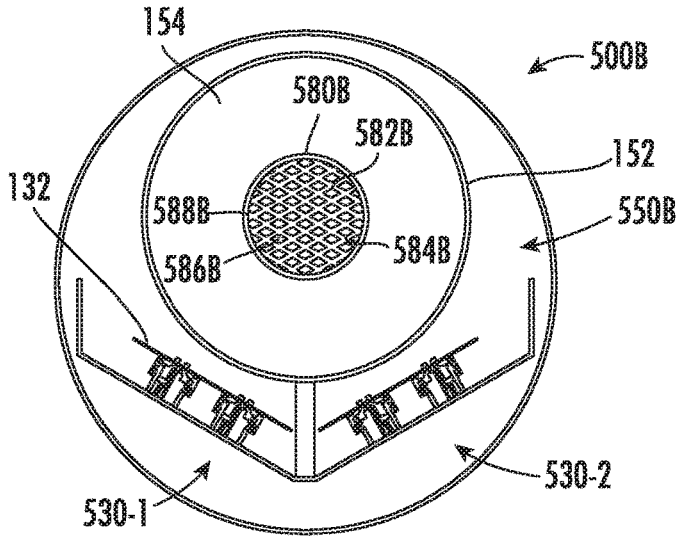

As shown in FIG. 7B, in another example embodiment, a heat dissipation pipe 580B is provided that includes an internal support structure 582B in the form of a longitudinally-extending walls 584B that defines a plurality of longitudinally-extending internal channels 586B having generally diamond-shaped transverse cross-sections. The heat dissipation pipe 580B may potentially provide enhance structural support as compared to heat dissipation pipe 580A, and may also have more uniform heat dissipation characteristics with respect to different portions of the RF lens 550B. However, the heat dissipation pipe 580B has smaller internal channels 586B and thus may have reduced heat dissipation capabilities, and it will generally be more difficult for heat to pass to inner ones of the interior channels 586B for venting from the RF lens 550B.

Figure 7C:
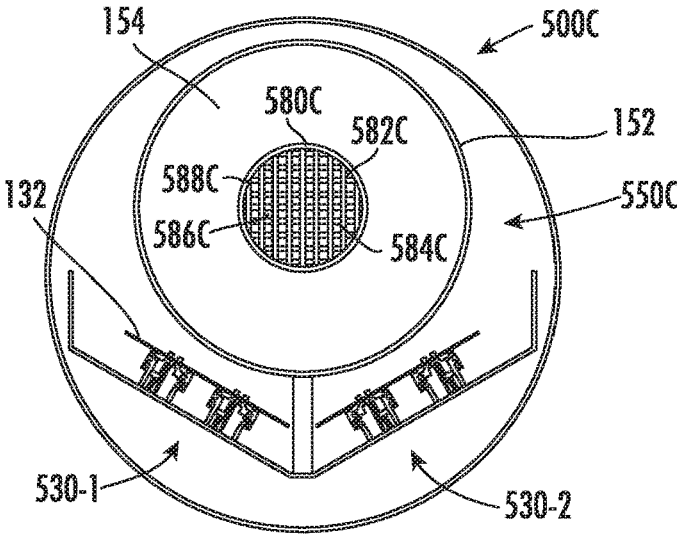

As shown in FIG. 7C, in yet another example embodiment, a heat dissipation pipe 580C is provided that includes an internal support structure 582C in the form of longitudinally-extending walls 584C that define a plurality of longitudinally-extending channels 586C having generally square-shaped transverse cross-sections. The heat dissipation pipe 580C may have performance characteristics similar to heat dissipation pipe 580B, and hence further description thereof will be omitted here.

It will also be appreciated that more than one RF lens may be included in the base station antennas according to embodiments of the present invention. For example, the base station antennas described above each included a single circular cylindrical RF lens that extended the entire length of the antenna. It will be appreciated, however, that these circular cylindrical antennas could be replaced with a stack of multiple circular cylindrical RF lenses that may be identical to the above-described RF lens except that each RF lens may have a shorter height. These shorter RF lenses could be stacked to provide a multi-piece RF lens having the exact same shape as the RF lenses described above. Alternatively, small gaps could be provided between the stacked lens to further facilitate air flow through the heat dissipation pipes.

Figure 8A:
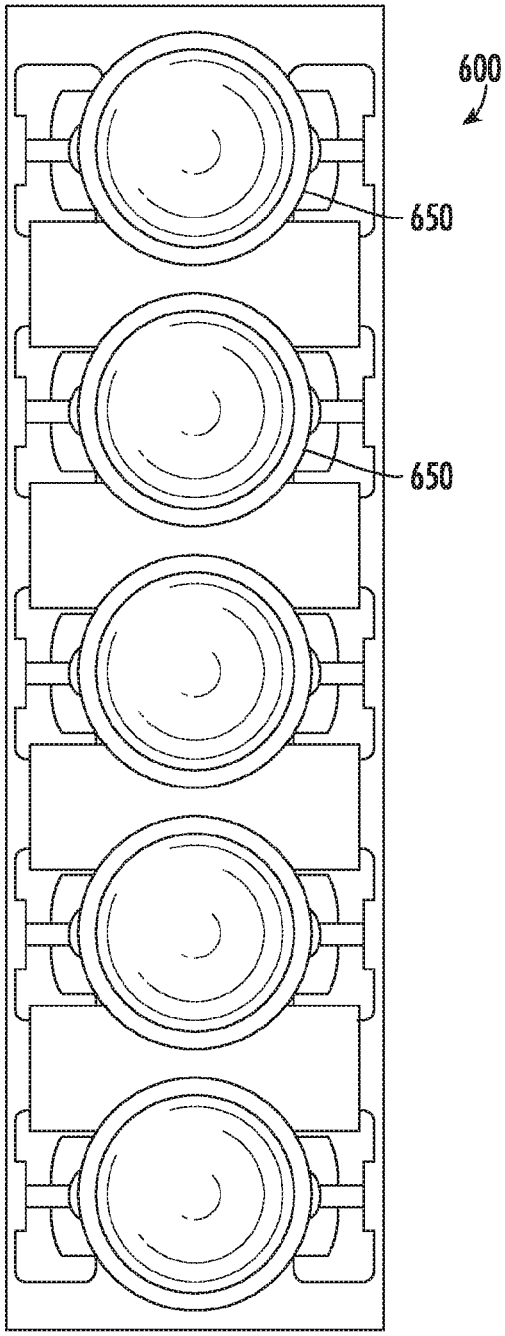
FIG. 8A is a schematic front view of lensed base station antenna according to embodiments of the present invention that includes an array of spherical RF lenses.

As another example, a plurality of spherical RF lenses or a plurality of elliptical RF lenses could be used in place of the circular cylindrical RF lenses described above. For example, FIG. 8A is a schematic front view of a base station antenna 600 according to embodiments of the present invention that includes five spherical RF lenses 650 instead of a single circular cylindrical RF lens. Base station antenna 600 may be similar to the base station antenna 100 that is described above, except that the cylindrical lens 150 is replaced with the five spherical RF lenses 650 in antenna 600. Additionally, shorter linear arrays are used in antenna 600 that only have five radiating elements each, and thus each RF lens 650 has a total of three radiating elements mounted behind the lens, namely a radiating element from each linear array.

Figure 8B:
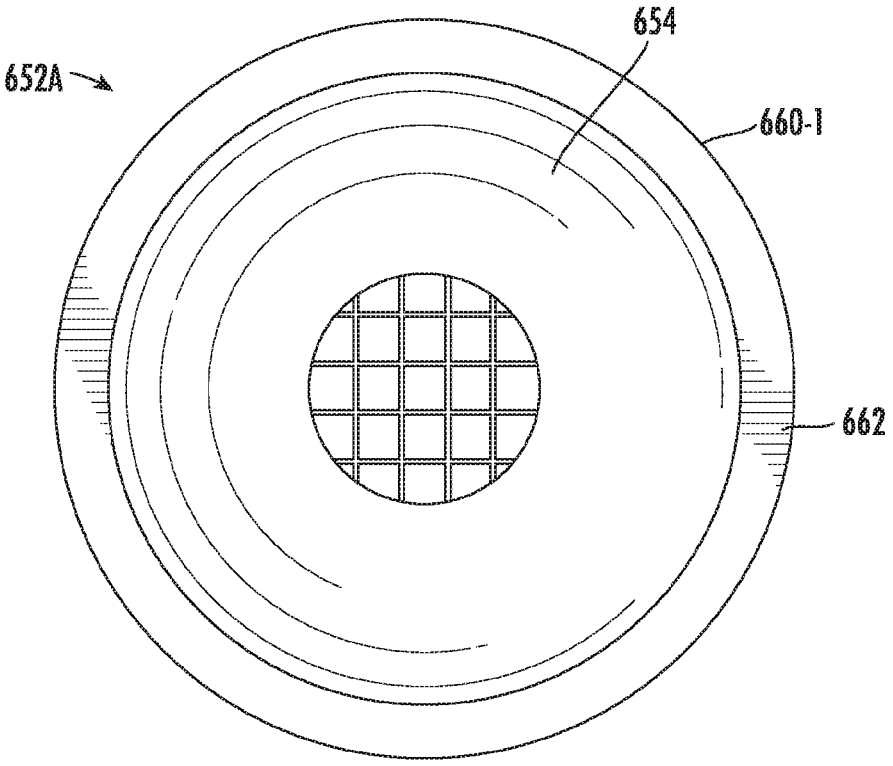
FIG. 8B is a schematic top view of the lens casing for one of the spherical RF lenses included in the antenna of FIG. 8A.
Figure 8C:
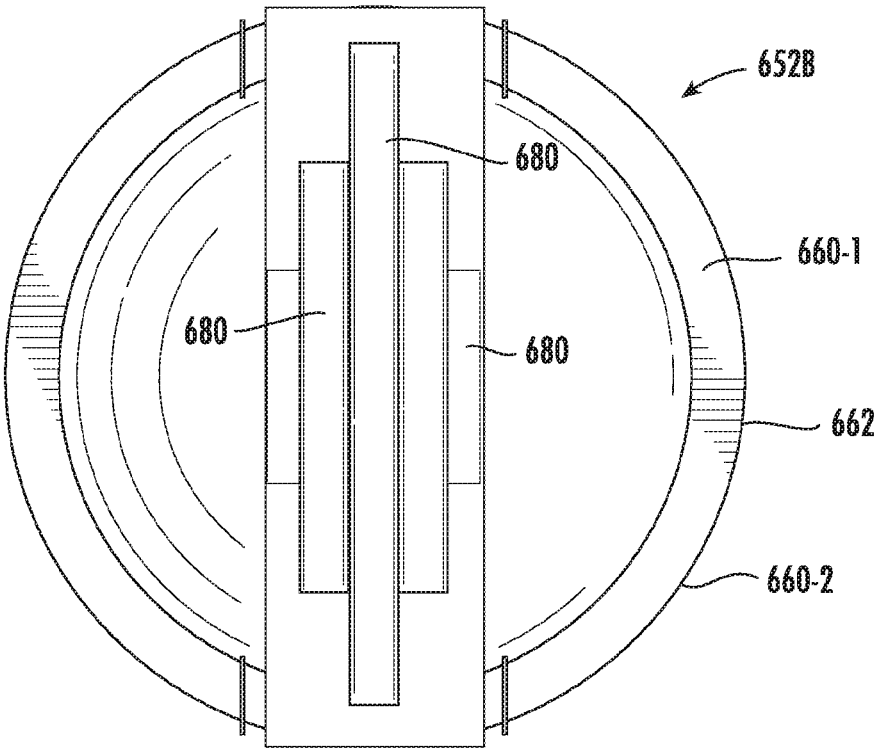
FIG. 8C is a schematic cross sectional-view of a slightly modified version of the lens casing of FIG. 8B.

The spherical RF lenses 650 included in antenna 600 may include heat dissipation elements, and may also be designed to function as, for example, a three-step approximation of a Luneberg lens. FIGS. 8B and 8C illustrate two potential designs for the lens casing, labeled 652A and 652B, of the spherical RF lenses 650 shown in FIG. 8A. In particular, FIG. 8B is a schematic top view of the lens casing 652A of one of the spherical RF lenses 650, while FIG. 8C is a schematic cross sectional-view of a lens casing 652B that is a slightly modified version the lens casing 652A of FIG. 8B.

Referring to FIGS. 8B-8C, the lens casings 652A, 652B each have upper and lower pieces 660-1, 660-2, which may be identical. An outwardly extending lip 662 extends around the periphery of each piece 660 so that when the two pieces 660 are joined together to form the spherical RF lens 650 the lips 662 of each piece 660 mate together. An adhesive (not shown) may be applied on one or both lips 652 to affix the two pieces 660 together.

Each lens casing 652A, 652B further includes a plurality of heat dissipation pipes 680 that are formed integral with the outer wall 654 of the respective lens casings 652A, 652B. The heat dissipation pipes 680 extend vertically through each lens casing 652A, 652B. It will be appreciated that FIGS. 8B and 8C illustrate slightly different implementations of the lens casing. In particular, in the embodiment of FIG. 6B, each heat dissipation channel 680 extends all the way through the lens casing 652A, while in the embodiment of FIG. 8C, only the heat dissipation pipes 680 in the middle if the lens casing extend all the way through the lens casing 652B.

The interior of the lens casings 652A, 652B may be filled with an RF energy focusing material 154. Each heat dissipation pipe 680 may be filled with air, and thus may serve to dissipate heat that builds up in the RF energy focusing material 154 that is near the center of the RF lenses 650. The thickness of the outer walls of the heat dissipation pipes 650 and the dielectric constant of the material used to form the heat dissipation pipes 680 may be selected so that the blended dielectric constant of the heat dissipation pipes 680 (including the air in the channels thereof) may be higher than the dielectric constant of the RF energy focusing material 154 so that the RF lenses 650 may comprise at least a three step approximation of a Luneberg lens.

Figure 9A:
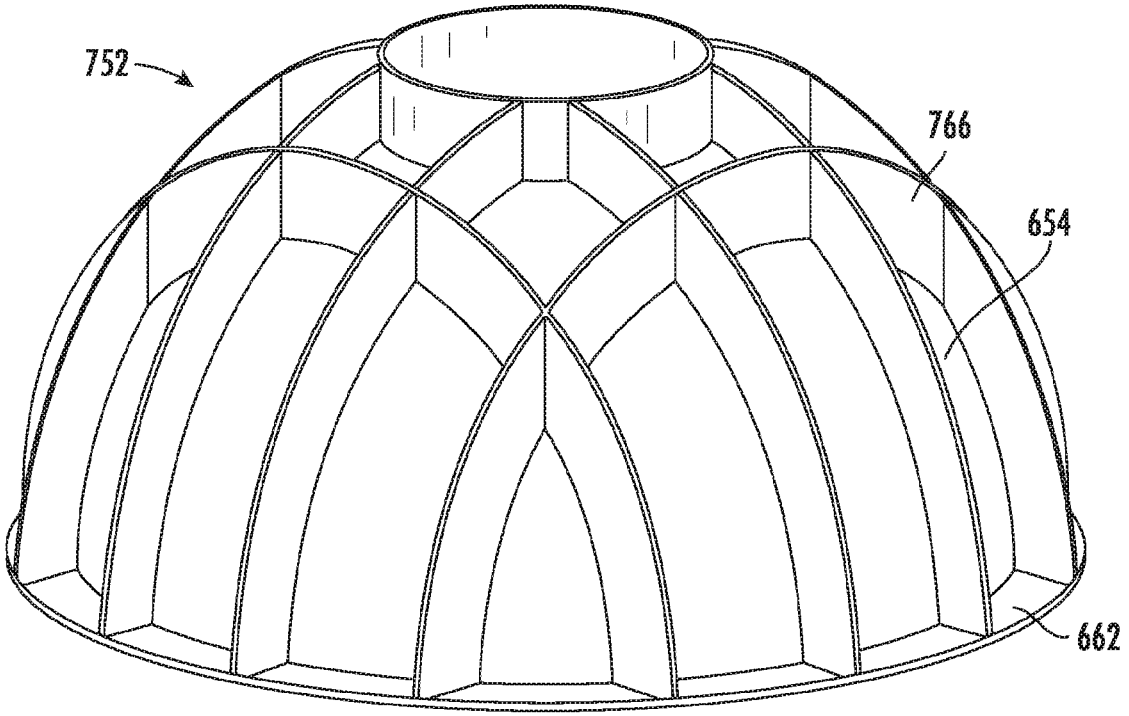
FIG. 9A is a perspective view of the upper half of an alternative spherical RF lenses that could be used in the antenna of FIG. 8A.
Figure 9B:
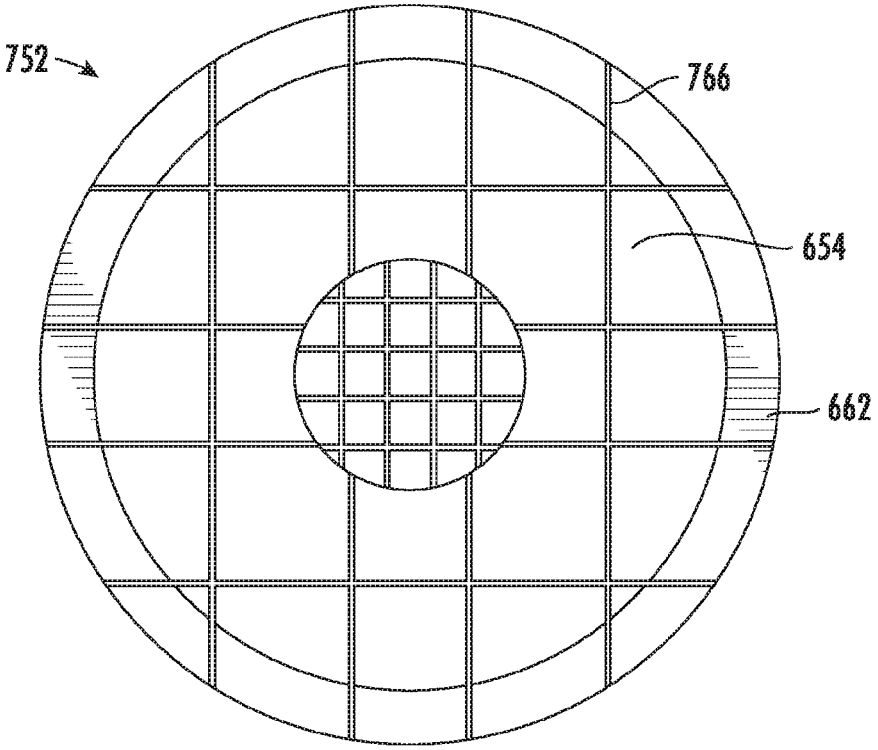
FIG. 9B is a top view of the spherical RF lens of FIG. 9A.

As described above, the lens casing for the RF lenses according to embodiments of the present invention may be designed so that the RF lens may be a four (or more) step approximation of a Luneberg lens. FIGS. 9A-9B illustrate a lens casing 752 for a spherical RF lens that may be used in place of the lens casings 652A, 652B illustrated in FIGS. 8B and 8C. In particular, FIG. 9A is a perspective view of the upper half of the lens casing 752, while FIG. 9B is a top view of lens casing 752.

As shown in FIGS. 9A-9B, the lens casing 752 is very similar to the lens casings 652A, 652B, except that the lens casing 752 includes a plurality of external protrusions 766 in the form of ribs. The space between adjacent ribs 766 may be filled with air. Consequently, RF energy that is transmitted through the lens casing 752 will through both the outer wall 654 of the lens casing 752 as well as through the ribs 766. As a result, the blended dielectric constant of the outer wall 654 of the lens casing and the ribs 766 will be a weighted average of the dielectric constant of the material used to fowl the outer wall 654 and the ribs 766 as well as the air that is between the ribs 766. Accordingly, by appropriate selection of the dielectric constant of the lens spacing material, the thickness of the outer wall 654, the thickness of the ribs 766, the height of the ribs 766 and the spacing between ribs 766, the lens casing 752 may be designed to have a dielectric constant that is less than the dielectric constant of the RF energy focusing material 154 that is deposited within the lens casing 752, and hence the lens casing 752 may be designed to be a four-step approximation of a Luneberg lens.

In an example embodiment, the lens casing may have a diameter of 210 mm (to the outer edges of the ribs) and the outer wall may define a sphere having a diameter of 180 mm, so each rib may be 15 mm tall. The "chimney" containing the internal channels may have a diameter of 75 mm. In some embodiments, the lens casing may have an ellipsoid shape with overall dimensions of 210 mm×210 mm×190 mm.

It will be appreciated that the present specification only describes a few example embodiments of the present invention and that the techniques described herein have applicability beyond the example embodiments described above. It should also be noted that the antennas according to embodiments of the present invention may be used in applications other than sector-splitting such as, for example, in venues such as stadiums, coliseums, convention centers and the like. In such applications, the multiple beams are more usually configured to cover a 60°-90° sector.

It will likewise be appreciated that the non-lens portions of the base station antennas according to embodiments of the present invention may have any appropriate design, including different numbers of linear arrays, different array designs, different types of radiating elements, etc.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A lensed base station antenna, comprising:

a first array that includes a plurality of radiating elements that are configured to transmit respective sub-components of a first radio frequency ("RF") signal;

an RF lens positioned to receive electromagnetic radiation from a first of the radiating elements, the RF lens including:

a lens casing;

an RF energy focusing material within the lens casing; and a first heat dissipation element that extends through the RF energy focusing material.

2. The lensed base station antenna according to claim 1, wherein the RF lens is configured to be a step approximation of a Luneberg lens, where the step approximation is at least a three step approximation along a boresight pointing direction of the first of the radiating elements.

3. The lensed base station antenna according to claim 1, wherein the first heat dissipation element comprises a vertically-extending pipe that extends through the RF lens when the base station antenna is mounted for use.

4. The lensed base station antenna according to claim 3, wherein the vertically-extending pipe includes a plurality of vertically-extending internal channels.

5. The lensed base station antenna according to claim 4, wherein at least some of the internal channels are air-filled channels.

6. The lensed base station antenna according to claim 4, wherein a blended dielectric constant of the vertically-extending pipe and one or more materials that are within the internal channels of the vertically-extending pipe exceed a dielectric constant of the RF energy focusing material.

7. The lensed base station antenna according to claim 1, wherein the lens casing includes a plurality of internal channels.

8. The lensed base station antenna according to claim 1, further comprising a housing, wherein the RF lens is within the housing and the first heat dissipation element extends through the housing.

9. The lensed base station antenna according to claim 1, wherein the lens casing includes a plurality of outwardly extending protrusions.

10. A lensed base station antenna, comprising:

a first array that includes a plurality of radiating elements that are configured to transmit respective sub-components of a first radio frequency ("RF") signal;

an RF lens positioned to receive electromagnetic radiation from a first of the radiating elements, the RF lens including an outer lens casing that includes at least one air-filled internal channel and an RF energy focusing material within an interior of the outer lens casing.

11. The lensed base station antenna according to claim 10, a blended dielectric constant of the outer lens casing is less than a dielectric constant of the RF energy focusing material.

12. The lensed base station antenna according to claim 10, wherein the outer lens casing includes a plurality of air-filled internal channels.

13. The lensed base station antenna according to claim 10, further comprising a first heat dissipation channel that extends through the RF energy focusing material.

14. The lensed base station antenna according to claim 13, wherein the first heat dissipation channel comprises a vertically-extending pipe that extends through a center of the RF lens when the base station antenna is mounted for use.

15. The lensed base station antenna according to claim 14, wherein the vertically-extending pipe includes a plurality of vertically-extending internal channels, and wherein a first subset of the internal channels are air-filled channels.

16. The lensed base station antenna according to claim 10, wherein the RF lens is configured to be a step approximation of a Luneberg lens, where the step approximation is at least a three step approximation along a boresight pointing direction of the first of the radiating elements.

17. A lensed base station antenna, comprising:

a first array that includes a plurality of radiating elements that are configured to transmit respective sub-components of a first radio frequency ("RF") signal;

an RF lens positioned to receive electromagnetic radiation from a first of the radiating elements, the RF lens including a lens casing that has a plurality of outwardly extending ribs and at least one air-filled internal channel, and an RF energy focusing material within the lens casing.

18. The lensed base station antenna according to claim 17, wherein the RF lens is configured to be a step approximation of a Luneberg lens, where the step approximation is at least a three step approximation along a boresight pointing direction of the first of the radiating elements.

19. The lensed base station antenna according to claim 17 wherein the RF lens comprises one of a spherical RF lens and an ellipsoidal RF lens, and wherein the lens casing comprises a two piece lens casing and each piece of the lens casing includes an outer lip.

20. The lensed base station antenna according to claim 17, wherein the at least one air-filled internal channel comprises at least first and second air-filled internal channels, and the first air-filled internal channel extends through a center of the RF lens has a first length and the second of the air-filled internal channel has a second length that is less than the first length.

* * * * *